US008296999B2

(12) United States Patent
Uhl

(10) Patent No.: US 8,296,999 B2
(45) Date of Patent: Oct. 30, 2012

(54) BLEACHER SYSTEM

(75) Inventor: Robert D. Uhl, Louisville, KY (US)

(73) Assignee: Century Industries, LLC, Sellersburg, IN (US)

( * ) Notice: Subject to any disclaimer, the term of this patent is extended or adjusted under 35 U.S.C. 154(b) by 0 days.

(21) Appl. No.: 13/045,981

(22) Filed: Mar. 11, 2011

(65) Prior Publication Data

US 2011/0219705 A1 Sep. 15, 2011

Related U.S. Application Data

(60) Provisional application No. 61/313,263, filed on Mar. 12, 2010.

(51) Int. Cl.
*E04H 3/12* (2006.01)

(52) U.S. Cl. ..... 52/9; 52/7; 52/66; 52/69

(58) Field of Classification Search ..... 52/6–10, 52/66, 68, 69; 182/222, 63.1, 127
See application file for complete search history.

(56) References Cited

U.S. PATENT DOCUMENTS

| | | | | |
|---|---|---|---|---|
| 2,983,968 A | | 5/1961 | Wurn | |
| 3,001,243 A | * | 9/1961 | Conn et al. | 52/10 |
| 3,103,707 A | | 9/1963 | Lappin et al. | |
| 3,478,473 A | | 11/1969 | Hoven | |
| 3,786,951 A | * | 1/1974 | Ruff et al. | 414/495 |
| 3,869,835 A | | 3/1975 | Mackintosh | |
| 3,885,827 A | * | 5/1975 | Sanders | 296/64 |
| 4,611,439 A | * | 9/1986 | Graham, Jr. | 52/9 |
| 4,909,000 A | * | 3/1990 | Mackintosh | 52/9 |
| 5,327,698 A | | 7/1994 | Uhl | |
| 5,400,551 A | | 3/1995 | Uhl | |
| 5,660,000 A | * | 8/1997 | MacIntyre | 52/9 |
| 5,979,125 A | * | 11/1999 | Guillet | 52/143 |
| 6,003,270 A | * | 12/1999 | MacIntyre | 52/10 |

(Continued)

FOREIGN PATENT DOCUMENTS

GB 2204338 A * 11/1988

OTHER PUBLICATIONS

ISA/US, International Search Report and Written Opinion issued in corresponding international application No. PCT/US11/28051, mailed May 5, 2011.

(Continued)

*Primary Examiner* — Brian Glessner
*Assistant Examiner* — Brian D Mattei
(74) *Attorney, Agent, or Firm* — Stites & Harbison, PLLC; David W. Nagle, Jr.

(57) ABSTRACT

A bleacher system comprises: a support structure mounted on wheels; two or more tiers mounted on the support structure, each tier including multiple girders at spaced intervals that are operably connected to the support structure, each girder supporting a plurality of seat supports and a plurality of foot board supports, with seat planks then secured to the seat supports and foot planks secured to the foot board supports in each tier; and at least one actuator operably connected to and extending between the support structure and a selected tier, such that extension of a rod of the hydraulic actuator causes the selected tier to pivot from a transport position into a deployed position, while also causing a corresponding movement of the remaining tiers from the transport position into the deployed position.

17 Claims, 33 Drawing Sheets

U.S. PATENT DOCUMENTS 7,234,720 B2 6/2007 Borglum

OTHER PUBLICATIONS

Century Industries, LLC, Transport Mobile Bleachers Model TSP 180 Product Sheet.

Century Industries, LLC, Transport Mobile Bleachers Model TSP 260 Product Sheet.

Century Industries, LLC, Transport Mobile Bleachers Model TSP 300 Product Sheet.

* cited by examiner

BLEACHER SYSTEM

CROSS-REFERENCE TO RELATED APPLICATIONS

The present application claims priority to U.S. Provisional Patent Application Ser. No. 61/313,263 filed on Mar. 12, 2010, the entire disclosure of which is incorporated herein by reference.

BACKGROUND OF THE INVENTION

Bleachers (or grandstands) provide seating for an audience for various sporting events, theatrical performances, and other similar events. Permanent bleachers are installed in gymnasiums or other locations where such events are frequent. However, for events that occur on a less frequent basis, temporary bleacher systems may be used. Such temporary bleacher systems are often mounted on some form of mobile framework for ready transport to the location of the event. Once at the appropriate location, the bleacher system can be transitioned from the transport position to a deployed position. Thus, such mobile bleacher systems provide short-term and special event seating without the time and labor required to set up conventional bleachers.

In prior art mobile bleacher systems, hydraulic actuators (or similar mechanical or electromechanical actuators) are often used to transition the bleacher system from the transport position to the deployed position, and vice versa. However, such hydraulic actuators are usually extended during transport and storage, and then refracted to transition the bleacher system to the deployed position. Because the hydraulic actuators are extended, the rods are susceptible to corrosion during transport from exposure to road salt and also susceptible to corrosion from environmental conditions during long periods of storage. Thus, expensive and maintenance-prone rod covers have often been used to address and minimize this problem.

Furthermore, in prior art mobile bleacher systems, complex actuating systems and multiple-step procedures are often required to transition the bleacher system from a transport position to a deployed position, and vice versa.

Furthermore, in prior art mobile bleacher systems, the number of rows in the bleacher system or leg room (pitch) from one seat row to the next is often sacrificed in order to make the bleacher system sufficiently compact for transport.

SUMMARY OF THE INVENTION

The present invention is a bleacher system (or grandstand) that is comprised of multiple tiers which are mounted on a support structure. The tiers are pivotally mounted to the support structure so that the bleacher system can be readily transitioned from a transport position to a deployed position. In this regard, such transition of the bleacher system from the transport position to the deployed position is achieved through the use of one or more hydraulic actuators (or similar mechanical or electromechanical actuators) that are retracted during transport and storage, and then extended to transition the bleacher system to the deployed position. Thus, the rods are protected from exposure to road salt and environmental conditions during transport and storage. Furthermore, as a result of the configuration of the tiers and their connection to the underlying support structure and each other, deployment requires only a single actuating action. At the same time, there is no sacrifice in the number of rows in the bleacher system or leg room (pitch) from one seat row to the next.

In one embodiment of the present invention, an exemplary bleacher system includes three tiers that are mounted to an underlying support structure, which includes two parallel rails that are spaced from one another and extend the length of the bleacher system. Multiple cross members extend between and connect the two parallel rails along the length of the bleacher system. Wheels and an associated suspension system are mounted to the rails to facilitate transport of the bleacher system.

Each tier is then generally constructed of multiple girders at spaced intervals that are operably connected to the underlying support structure. Each girder in each tier supports multiple seat supports and foot board supports, with respective seat planks and foot planks then being secured to the respective seat supports and foot board supports and extending along the length of the bleacher system over such seat supports and foot board supports.

Each girder of the upper tier is connected to a rear strut by a pin connection defining a pivot point. The pivot points defined by the respective pin connections are aligned and effectively define an axis of rotation along the length of the bleacher system. Each rear strut is also connected to the underlying support structure by a pin connection defining another pivot point.

The upper tier is connected to the middle tier by a pin connection defining a pivot point. Again, there are actually multiple such pin connections and associated pivot points that are aligned along the length of the bleacher system that effectively define an axis of rotation along the length of the bleacher system. Furthermore, each girder of the middle tier includes a generally triangular-shaped strut. The pivot point is at a rear corner of this strut, and a lower corner of this strut is mounted to the underlying support structure for rotation about a main pivot point, such that the middle tier can effectively rotate about the main pivot point.

The lower tier is connected to the middle tier by a pin connection defining a pivot point. Again, there are actually multiple such pin connections and associated pivot points that are aligned along the length of the bleacher system that effectively define an axis of rotation along the length of the bleacher system.

With respect to the transition of the bleacher system from the transport position to the deployed position, and vice versa, there is a deployment link support structure that is secured to or integral with the underlying support structure for each hydraulic actuator. Each hydraulic actuator is connected to a respective deployment link support structure at a first end by a pin connection defining a pivot point. The rod of the hydraulic actuator is then connected to the middle tier by a pin connection defining a pivot point.

Furthermore, for each hydraulic actuator, a deployment link is connected to the deployment link support structure by a pin connection defining a pivot point. Each such deployment link extends toward the lower tier with its distal end being connected to a second, shorter deployment link by a pin connection defining a pivot point. The opposite end of this second, shorter deployment link is then connected to the girder of the lower tier by a pin connection defining a pivot point.

In operation, when transitioning from the deployed position to the transport position, each hydraulic actuator is activated in unison, and the respective rods of the hydraulic actuators begin to retract. As the rods retract, the middle tier begins rotating backward about the main pivot point. As a result, the respective pivot points at the pin connections between the middle tier and the lower tier are moved upward, and thus, the lower tier begins rotating toward the middle tier.

At the opposite end of the middle tier, the respective pivot points at the pin connections between the middle tier and the upper tier are moved downward. The upper tier thus begins rotating forward. Such simultaneous rotation of the three tiers continues as the rods of the hydraulic actuators retract. Furthermore, once tension is released in the connection between the deployment link and the second, shorter deployment link, these two components begin to rotate and "fold" relative to one another. Rotation of the three tiers ceases when the rods of the hydraulic actuators are fully refracted, at which time the rear struts are each in an upright orientation substantially perpendicular to the underlying support structure, and the bleacher system is in the transport position.

To transition the bleacher system from the transport position back to the deployed position, the respective rods of the hydraulic actuators are extended. The rods effectively push against the middle tier, causing the middle tier to rotate forward about the main pivot point. As a result, the respective pivot points at the pin connections between the middle tier and the lower tier are moved downward, and at the same time, the lower tier begins rotating away from the middle tier. As the lower tier rotates away from the middle tier, the deployment link and the second, shorter deployment link rotate into an aligned position, pushing the lower tier into the deployed position. At the opposite end of the middle tier, the respective pivot points at the pin connections between the middle tier and the upper tier are moved upward. The upper tier thus begins rotating backward. Rotation of the three tiers continues until the rods of the hydraulic actuators are fully extended, and the bleacher system is in the deployed position.

In another embodiment of the present invention, an exemplary bleacher system includes two tiers that are mounted to an underlying support structure, which includes two parallel rails that are spaced from one another and extend the length of the bleacher system. Multiple cross members extend between and connect the two parallel rails along the length of the bleacher system. Wheels and an associated suspension system are mounted to the rails to facilitate transport of the bleacher system.

Each tier is then generally constructed of multiple girders at spaced intervals that are operably connected to the underlying support structure. Each girder in each tier supports multiple seat supports and foot board supports, with respective seat planks and foot planks then being secured to the respective seat supports and foot board supports and extending along the length of the bleacher system over such seat supports and foot board supports.

Each girder of the upper tier is connected to a rear strut by a pin connection defining a pivot point. The pivot points defined by the respective pin connections are aligned and effectively define an axis of rotation along the length of the bleacher system. Each rear strut is also connected to the underlying support structure by a pin connection defining another pivot point.

The upper tier is connected to the lower tier by a pin connection defining a pivot point. Again, there are actually multiple such pin connections and associated pivot points that are aligned along the length of the bleacher system that effectively define an axis of rotation along the length of the bleacher system. Specifically, each girder of lower tier includes a vertical extension. The pin connection defining the pivot point between the upper tier and the lower tier at each girder is at a first end of this vertical extension, while the opposite end of the vertical extension is connected by a pin connection defining a pivot point to the underlying support structure.

With respect to the transition of the bleacher system from the transport position to the deployed position, and vice versa, a hydraulic actuator is connected to a plate (which is secured to and extends from the support structure) at a first end by a pin connection defining a pivot point. The rod of the hydraulic actuator is then connected to the lower tier by a pin connection defining a pivot point.

In operation, when transitioning from the deployed position to the transport position, when each hydraulic actuator is activated, the respective rods of the hydraulic actuators begin to retract. As the rods begin to retract, the lower tier begins rotating backward. As a result, the respective pivot points at the pin connections between the upper tier and the lower tier are moved downward, and thus, the upper tier begins rotating toward the lower tier. At the same time, the rear struts also begin rotating backward. Such simultaneous rotation of the upper tier and the lower tier continues as the rods of the hydraulic actuators retract. Rotation of the upper tier and the lower tier ceases when the rods of the hydraulic actuators are fully retracted, and the bleacher system is in the transport position.

Because individuals seated in bleachers are often exposed to the sun and weather, it is often desirable to incorporate a canopy assembly into a bleacher system. Thus, an exemplary bleacher system made in accordance with the present invention can optionally include a canopy assembly that can be collapsed for transport. In one exemplary embodiment, such a canopy assembly includes an overhead frame, and a canopy (such as a sunshade, weather, or other canopy) is stretched over and supported by this overhead frame. The canopy assembly further includes multiple rear canopy struts that are pivotally connected to the rear of the overhead frame and pivotally connected to the bleacher system. The canopy assembly further includes two diagonal support struts, one at each end of the bleacher system, with each diagonal support strut being pivotally connected to the bleacher system at a first end and pivotally connected to an end of a front truss of the overhead frame at a second end. Finally, the canopy assembly includes two vertical support struts, one at each end of the bleacher system, with each vertical support strut being pivotally connected to the front truss of the overhead frame at a first end and pivotally connected to the lower tier of the bleacher system at a second end.

Each vertical support strut is adapted to transition between an extended position and a refracted position. For instance, in one exemplary embodiment, each vertical support strut is actually comprised of two discrete structural elements that are pivotally connected to one another at a folding joint—an upper structural element and a lower structural element, so that each vertical support strut can fold as it moves from the deployed position to the transport position.

When the bleacher system has been transitioned to the transport position, the canopy assembly is initially still in its deployed position. To transition the canopy assembly to the transport portion (i.e., close the canopy assembly), the folding joint for each vertical support strut is unlocked. The upper structural element of each vertical support strut can then pivot relative to the lower structural element. The pivoting of the upper structural elements of each vertical support strut continues until the surface of the canopy is substantially vertical, covering one side of the bleacher system in the transport position.

In transitioning the canopy assembly from the transport position to the deployed position (i.e., opening the canopy assembly), the vertical support struts are straightened, and the respective folding joints are locked by inserting the locking pins. Then, as the bleacher system is deployed, the movement of the lower tier raises the front truss of the canopy assembly to the desired position, while the multiple rear canopy struts support the rear of the overhead frame at the desired height above the upper tier.

DETAILED DESCRIPTION OF THE INVENTION

Figure 1:
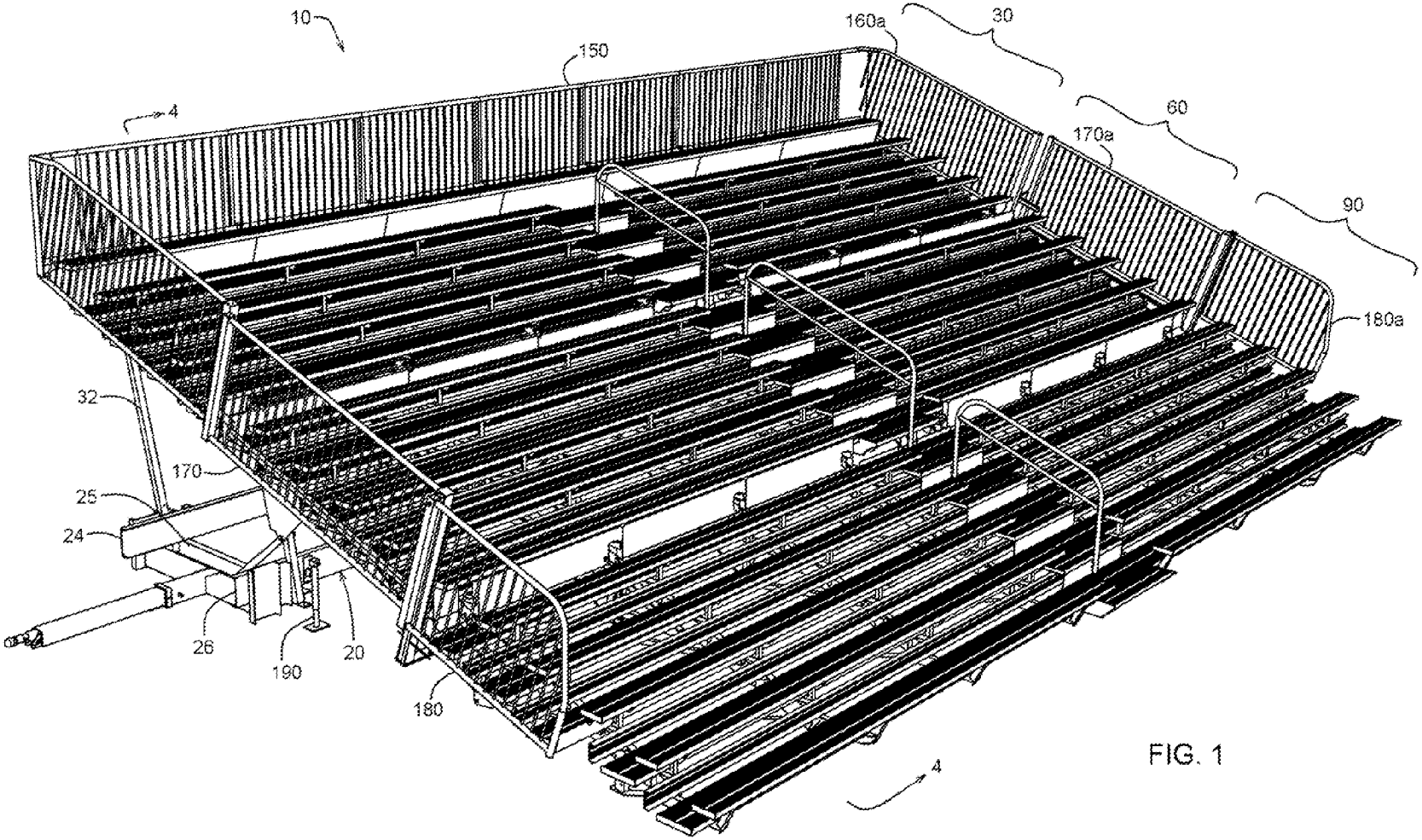
FIG. 1 is a perspective view of an exemplary 15-row bleacher system made in accordance with the present invention in a deployed position.

The bleacher system (or grandstand) of the present invention generally comprises multiple tiers which are mounted on a support structure. The tiers are pivotally mounted to the support structure so that the bleacher system can be readily transitioned from a transport position to a deployed position. In this regard, such transition of the bleacher system from the transport position to the deployed position is achieved through the use of one or more hydraulic actuators (or similar mechanical or electromechanical actuators) that are retracted during transport and storage, and then extended to transition the bleacher system to the deployed position. Thus, the rods are protected from exposure to road salt and environmental conditions during transport and storage. Furthermore, as a result of the configuration of the tiers and their connection to the underlying support structure and each other, deployment requires only a single actuating action. At the same time, there is no sacrifice in the number of rows in the bleacher system or leg room (pitch) from one seat row to the next.

FIGS. 1-4 are various views of an exemplary 15-row bleacher system 10 made in accordance with the present invention. As shown in FIGS. 1-4, there are three tiers 30, 60, 90 in this exemplary embodiment that are mounted to an underlying support structure 20, which includes two parallel rails 24, 26 that are spaced from one another and extend the length of the bleacher system 10. Multiple cross members 25 extend between and connect the two parallel rails 24, 26 along the length of the bleacher system 10. Wheels and an associated suspension system (collectively indicated by reference numeral 28 in FIG. 2) are mounted to the rails 24, 26 to facilitate transport of the bleacher system 10, and it is preferred that the bleacher system 10 is equipped with the necessary hitch, suspension, and other equipment as necessary to satisfy relevant Department of Transportation ("DOT") requirements so that the bleacher system, when in the transport position, can be towed behind a truck. In any event, each tier 30, 60, 90 is then generally constructed of multiple girders at spaced intervals that are operably connected to the underlying support structure 20.

Figure 2:
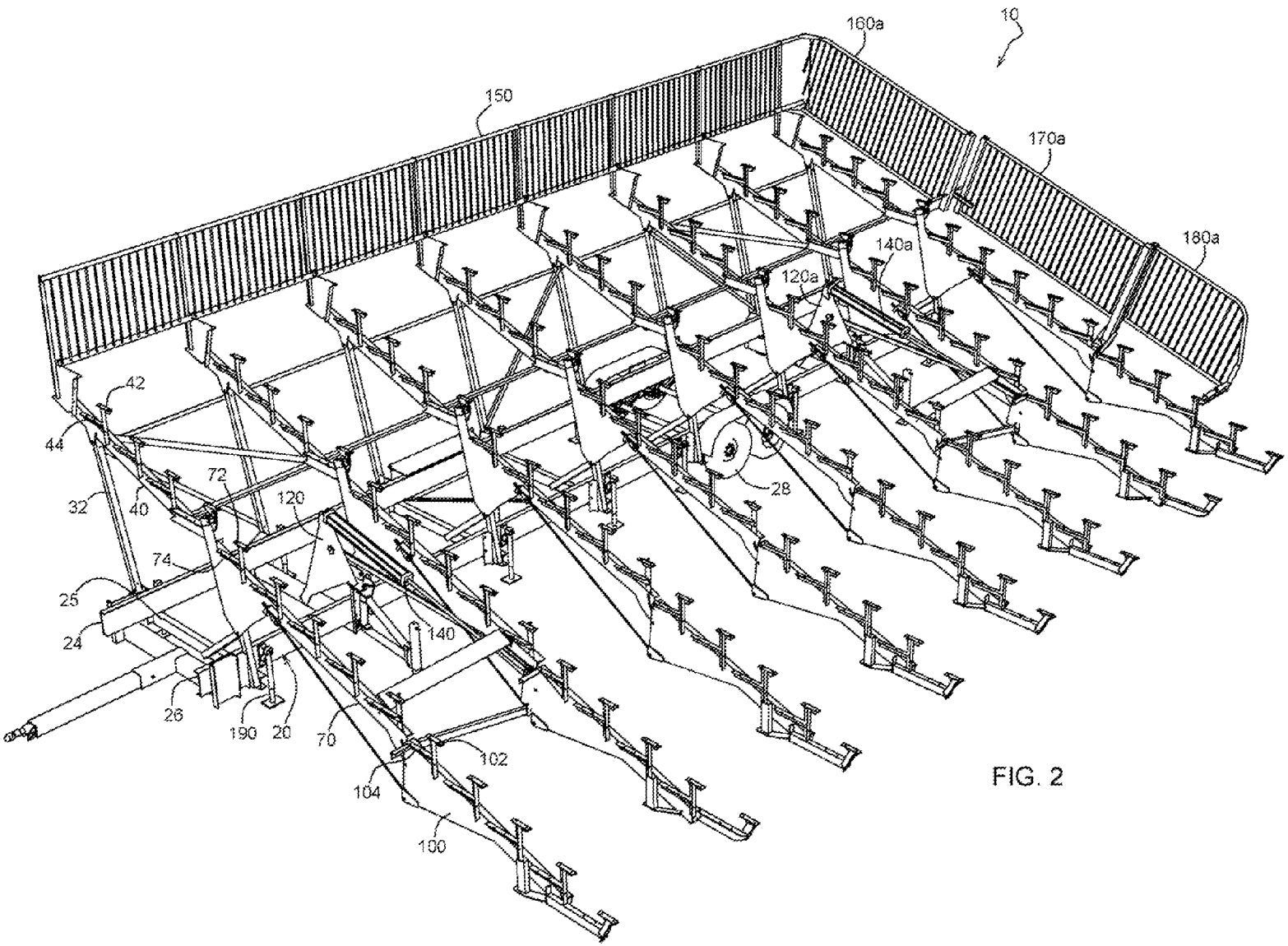
FIG. 2 is another perspective view of the exemplary bleacher system of FIG. 1, but with some components removed to better illustrate certain aspects of the construction of the bleacher system.
Figure 3:
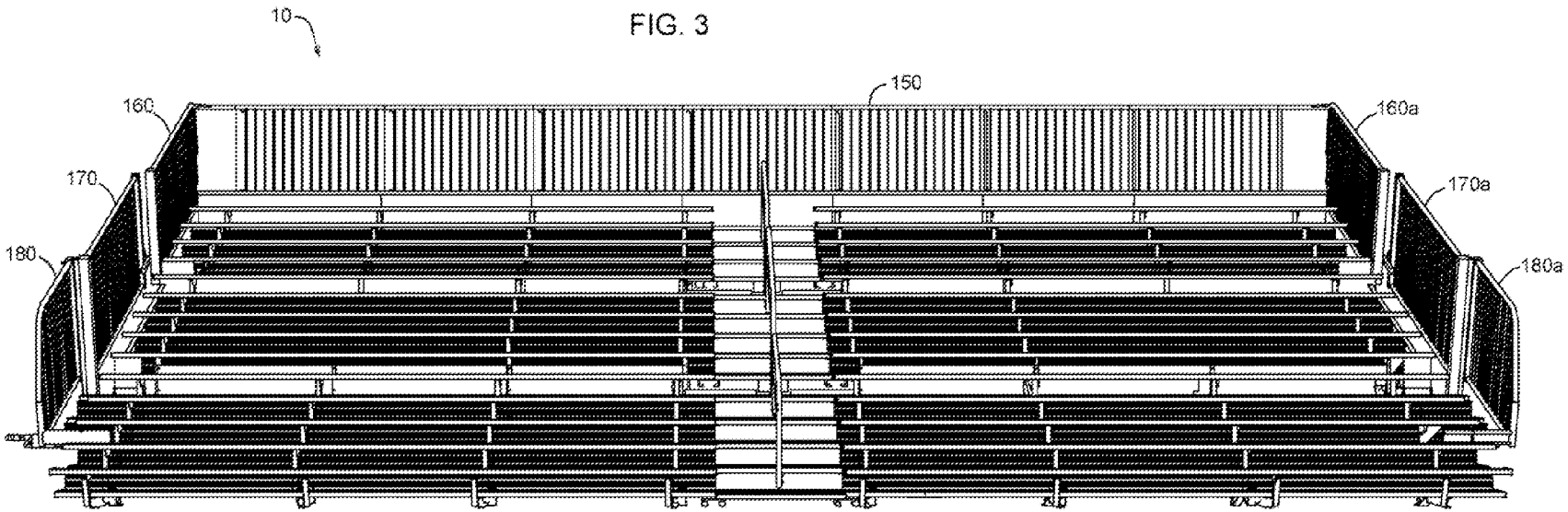
FIG. 3 is a front view of the exemplary bleacher system of FIG. 1.
Figure 4:
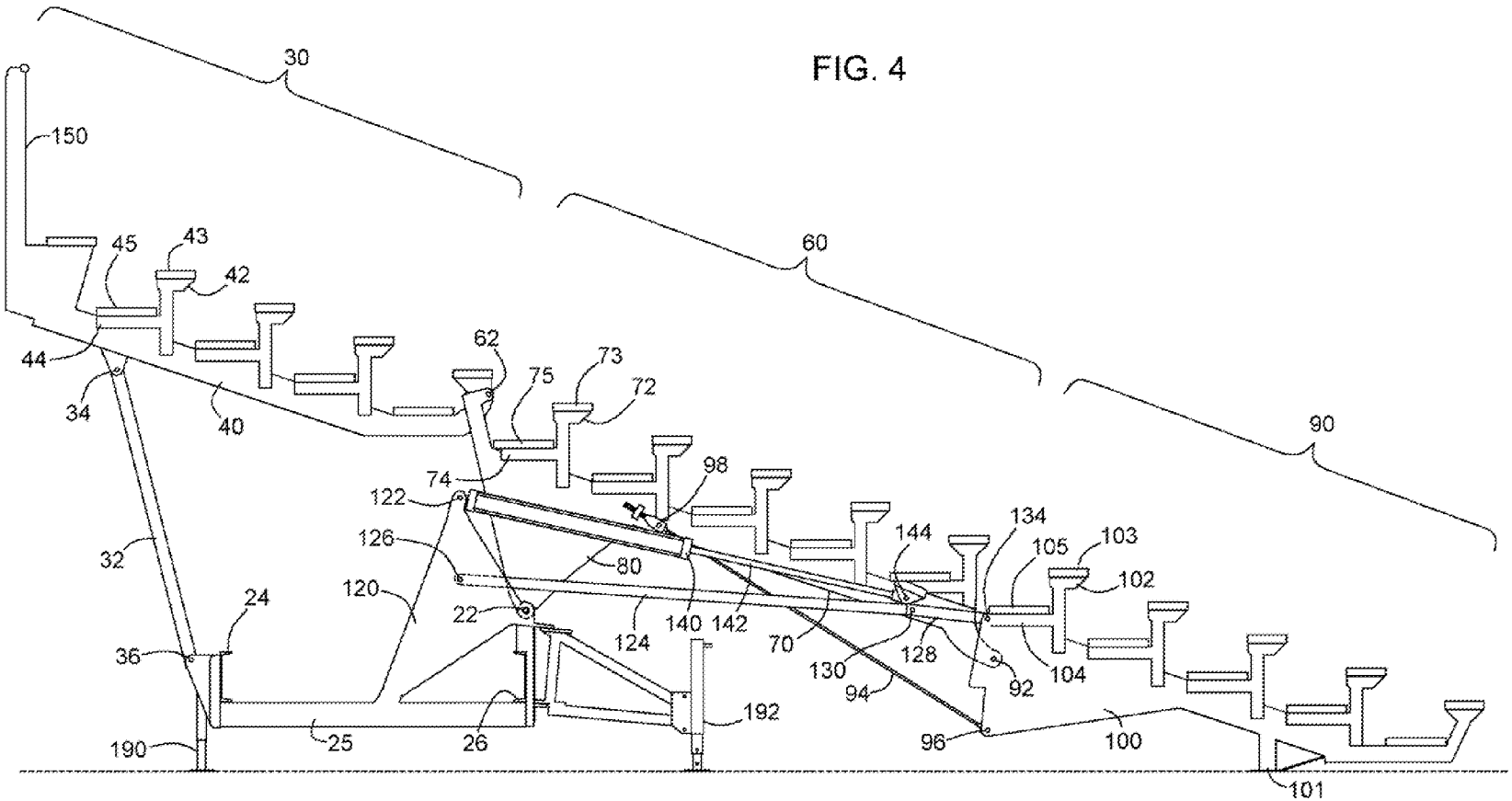
FIG. 4 is a side sectional view of the exemplary bleacher system taken along line 4-4 of FIG. 1, but with certain components, including the end guardrails, removed for clarity.
Figure 5:
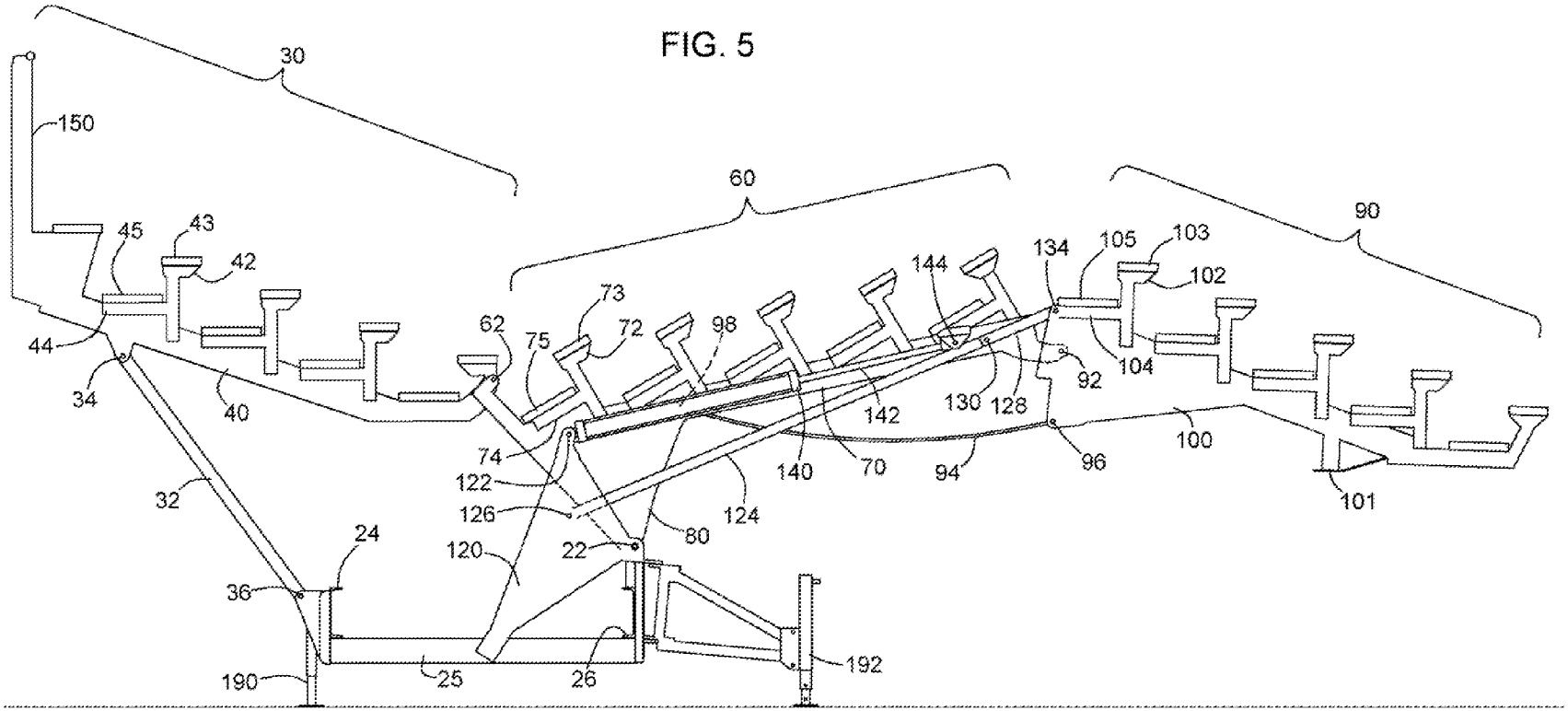
FIG. 5 is a side sectional view similar to FIG. 4, illustrating the bleacher system as it starts to transition from the deployed position to the transport position.
Figure 6:
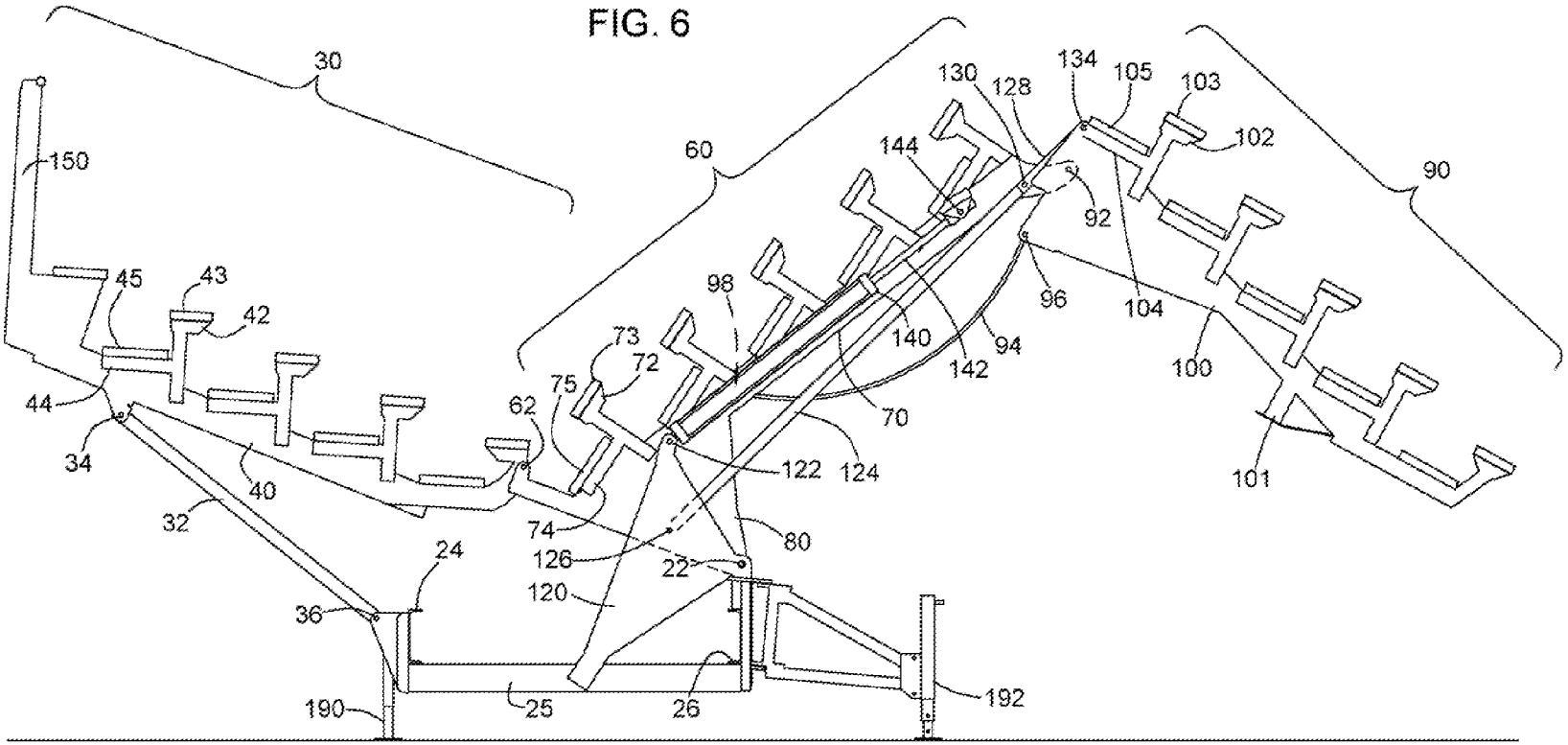
FIG. 6 is a side sectional view similar to FIG. 4, illustrating the bleacher system as it continues to transition from the deployed position to the transport position.

Specifically, and perhaps as best shown in FIGS. 2 and 4, the upper tier 30 is constructed from multiple girders 40 at spaced intervals. In this exemplary embodiment, eight such girders 40 are spaced at approximately six-foot intervals. Each girder 40 supports multiple seat supports 42 and foot board supports 44, with respective seat planks 43 and foot planks 45 then being secured to the respective seat supports 42 and foot board supports 44 and extending along the length of the bleacher system 10 over such seat supports 42 and foot board supports 44.

Similarly, the middle tier 60 is constructed from multiple girders 70 at spaced intervals. Each girder 70 supports multiple seat supports 72 and foot board supports 74, with respective seat planks 73 and foot planks 75 then being secured to the respective seat supports 72 and foot board supports 74 and extending along the length of the bleacher system 10 over such seat supports 72 and foot board supports 74.

Finally, the lower tier 90 is constructed from multiple girders 100 at spaced intervals. Each girder 100 supports multiple seat supports 102 and foot board supports 104, with respective seat planks 103 and foot planks 105 then being secured to the respective seat supports 102 and foot board supports 104 and extending along the length of the bleacher system 10 over such seat supports 102 and foot board supports 104.

More importantly, and referring to the side view of FIG. 4, the girder 40 of the upper tier 30 is connected to a rear strut 32 by a pin connection defining a pivot point 34. In this regard, as should be clear from the perspective views of FIGS. 1 and 2, there are actually multiple rear struts 32 and associated pin points 34, one associated with each girder 40 along the length of the bleacher system 10. The pivot points 34 defined by the respective pin connections are aligned and effectively define an axis of rotation along the length of the bleacher system 10, as further described below. Each rear strut 32 is thus pivotally connected to a girder 40 of the upper tier 30 at a first end, and then is connected to the underlying support structure 20 by a pin connection defining another pivot point 36.

Referring still to FIG. 4, the upper tier 30 is also connected to the middle tier 60 by a pin connection defining a pivot point 62. Again, there are actually multiple such pin connections and associated pivot points 62 that are aligned along the length of the bleacher system 10 that effectively define an axis of rotation along the length of the bleacher system 10. Furthermore, in this exemplary embodiment, each girder 70 of the middle tier 60 includes a generally triangular-shaped strut 80. The pivot point 62 is at a rear corner of this strut 80, and a lower corner of this strut 80 is mounted to the underlying support structure 20 for rotation about a main pivot point 22, such that the middle tier 60 can effectively rotate about the main pivot point 22.

Referring still to FIG. 4, the lower tier 90 can then pivot with respect to the middle tier 60. Specifically, in this exemplary embodiment, the lower tier 90 is connected to the middle tier 60 by a pin connection defining a pivot point 92. Again, there are actually multiple such pin connections and associated pivot points 92 that are aligned along the length of the bleacher system 10 that effectively define an axis of rotation along the length of the bleacher system 10. Furthermore, in this exemplary embodiment, each girder 100 has a generally triangular portion. There is a diagonal support cable 94 that is connected to this generally triangular portion at one end at pivot point 96 and to the girder 70 of the middle tier 60 at the opposite end. This support cable 94 is loose when the bleacher system 10 is in the transport position, but is pulled taut as the bleacher system 10 is transitioned into the deployed position, as further described below. Furthermore, in this exemplary embodiment, the opposite end of the support cable 94 is actually connected to an adjustable connector 98, which is then connected to the girder 70 of the middle tier 60. This adjustable connector 98 can thus be used to accommodate any stretching or variation in the length of the support cable 94.

Now, with respect to the transition of the bleacher system 10 from the transport position to the deployed position, and vice versa, there is a deployment link support structure 120 that is secured to or integral with the underlying support structure 20 for each hydraulic actuator 140 (or similar mechanical or electromechanical actuator). In the exemplary embodiment, and as best shown in FIG. 2, there are two such deployment link support structures 120, 120*a* and two hydraulic actuators 140, 140*a*. Referring now to FIG. 4, irrespective of the number of hydraulic actuators, each hydraulic actuator 140 is connected to a respective deployment link support structure 120 at a first end by a pin connection defining a pivot point 122. The rod 142 of the hydraulic actuator 140 is then connected to the middle tier 60 by a pin connection defining a pivot point 144.

Furthermore, for each hydraulic actuator 140, a deployment link 124 is connected to the deployment link support structure 120 by a pin connection defining a pivot point 126. Each such deployment link 124 extends toward the lower tier 90 with its distal end being connected to a second, shorter deployment link 128 by a pin connection defining a pivot point 130. The opposite end of this second, shorter deployment link 128 is then connected to the girder 100 of the lower tier 90 by a pin connection defining a pivot point 134.

Because of this construction, the exemplary bleacher system 10 can be readily transitioned from the transport position to the deployed position by extending the hydraulic actuators 140.

Referring now to FIGS. 5-8 and 9-13, in operation, when transitioning from the deployed position to the transport position, each hydraulic actuator 140 is activated in unison (for example, using a standard hydraulic pump), and the respective rods 142 of the hydraulic actuators 140 begin to retract. As the rods 142 refract, the middle tier 60 begins rotating backward (counterclockwise in FIGS. 5 and 10) about the main pivot point 22. As a result, the respective pivot points 92 at the pin connections between the middle tier 60 and the lower tier 90 are moved upward, and thus, the lower tier 90 begins rotating toward the middle tier 60 (clockwise in FIGS. 5 and 10) about the axis of rotation defined by the aligned pivot points 92. At the opposite end of the middle tier 60, the respective pivot points 62 at the pin connections between the middle tier 60 and the upper tier 30 are moved downward. The upper tier 30 thus begins rotating forward (clockwise in FIGS. 5 and 10) about the axis of rotation defined by the aligned pivot points 34.

Figure 7:
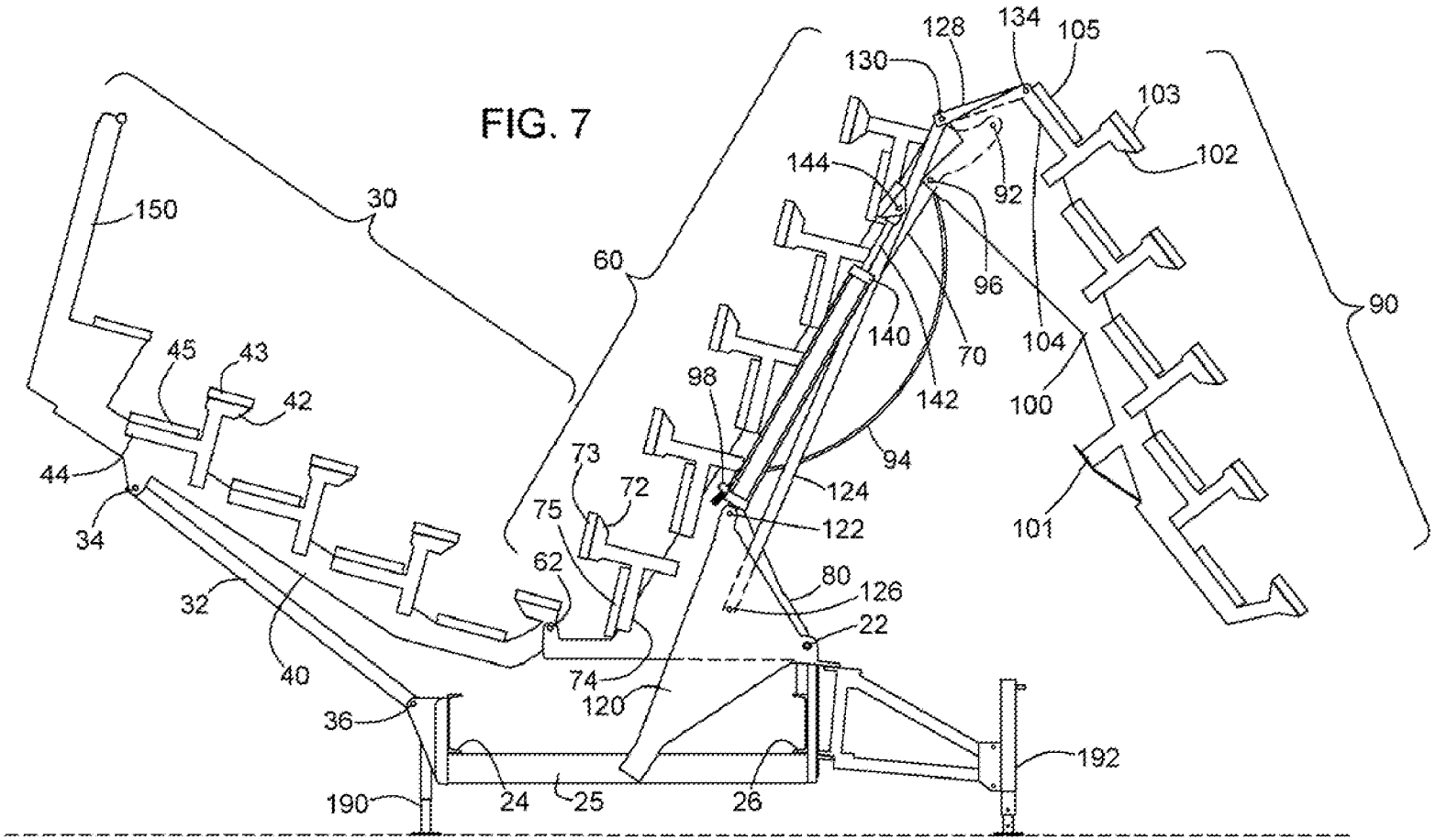
FIG. 7 is a side sectional view similar to FIG. 4, illustrating the bleacher system as it continues to transition from the deployed position to the transport position.

Such simultaneous rotation of the three tiers 30, 60, 90 continues as the rods 142 of the hydraulic actuators 140 retract. Furthermore, and as illustrated in FIG. 7, once tension is released in the connection between the deployment link 124 and the second, shorter deployment link 128, these two components begin to rotate and "fold" relative to one another about the pivot point 130.

Figure 8:
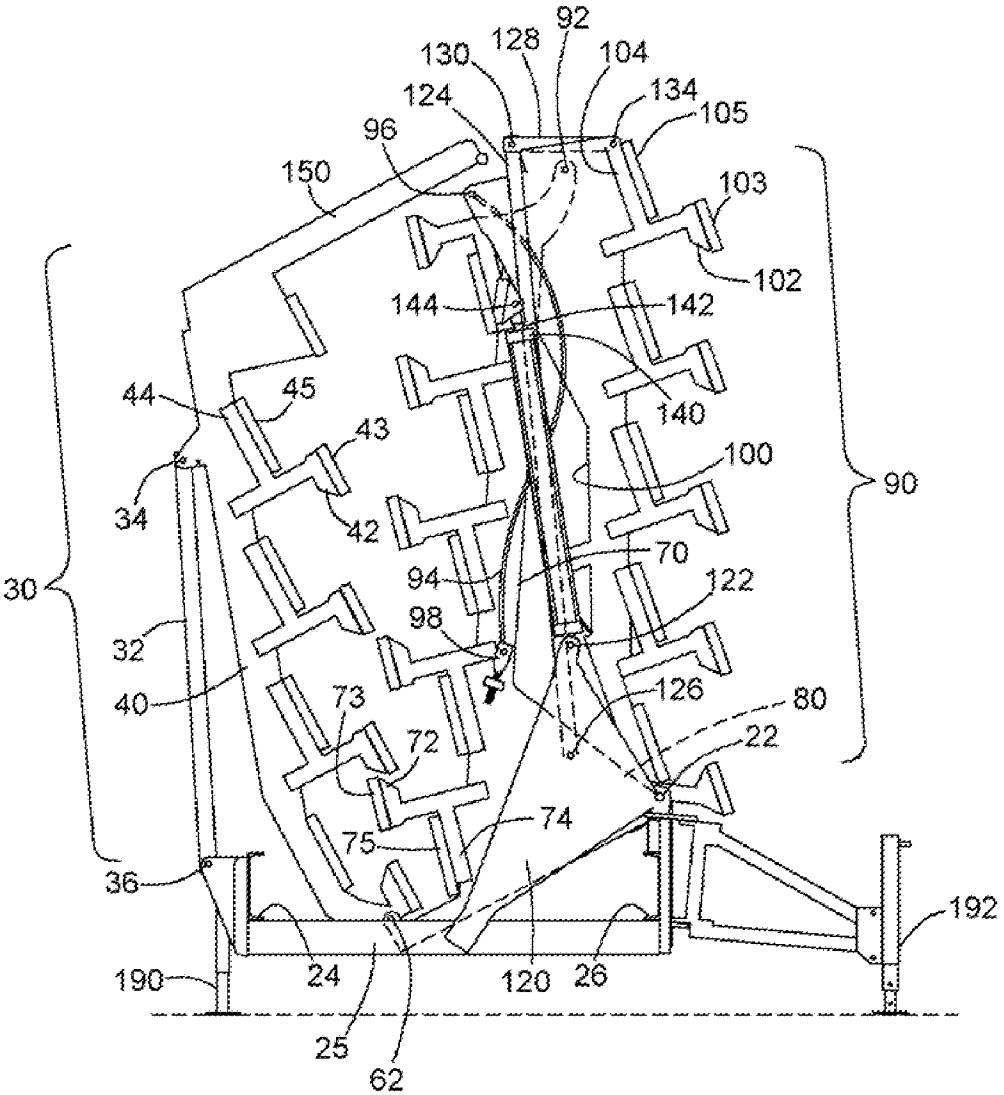
FIG. 8 is a side sectional view similar to FIG. 4, illustrating the bleacher system in the transport position.
Figure 9:
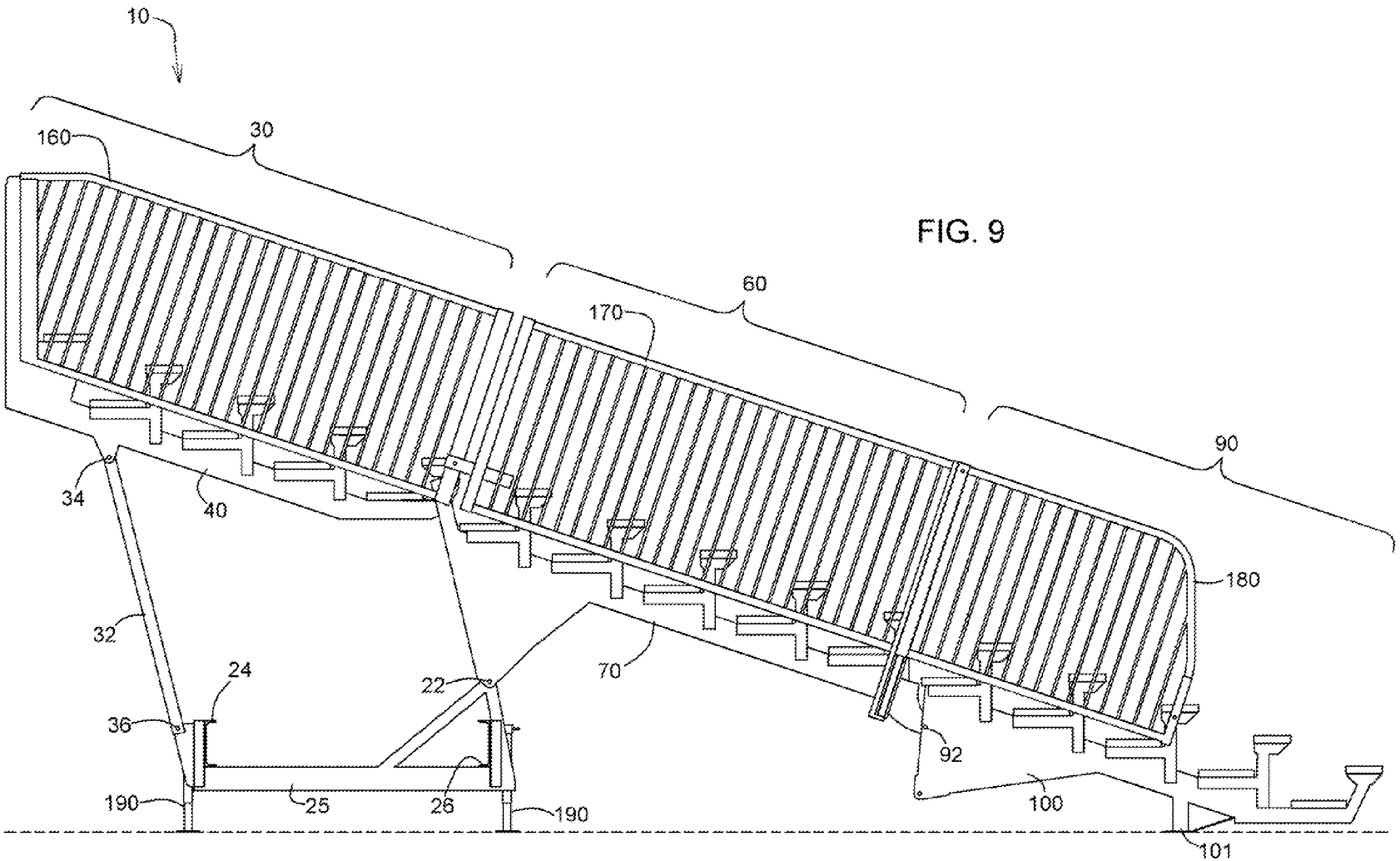
FIGS. 9-13 correspond to FIGS. 4-8, but are side views that include the end guardrails, while again illustrating the bleacher system as it transitions from the deployed position to the transport position.
Figure 10:
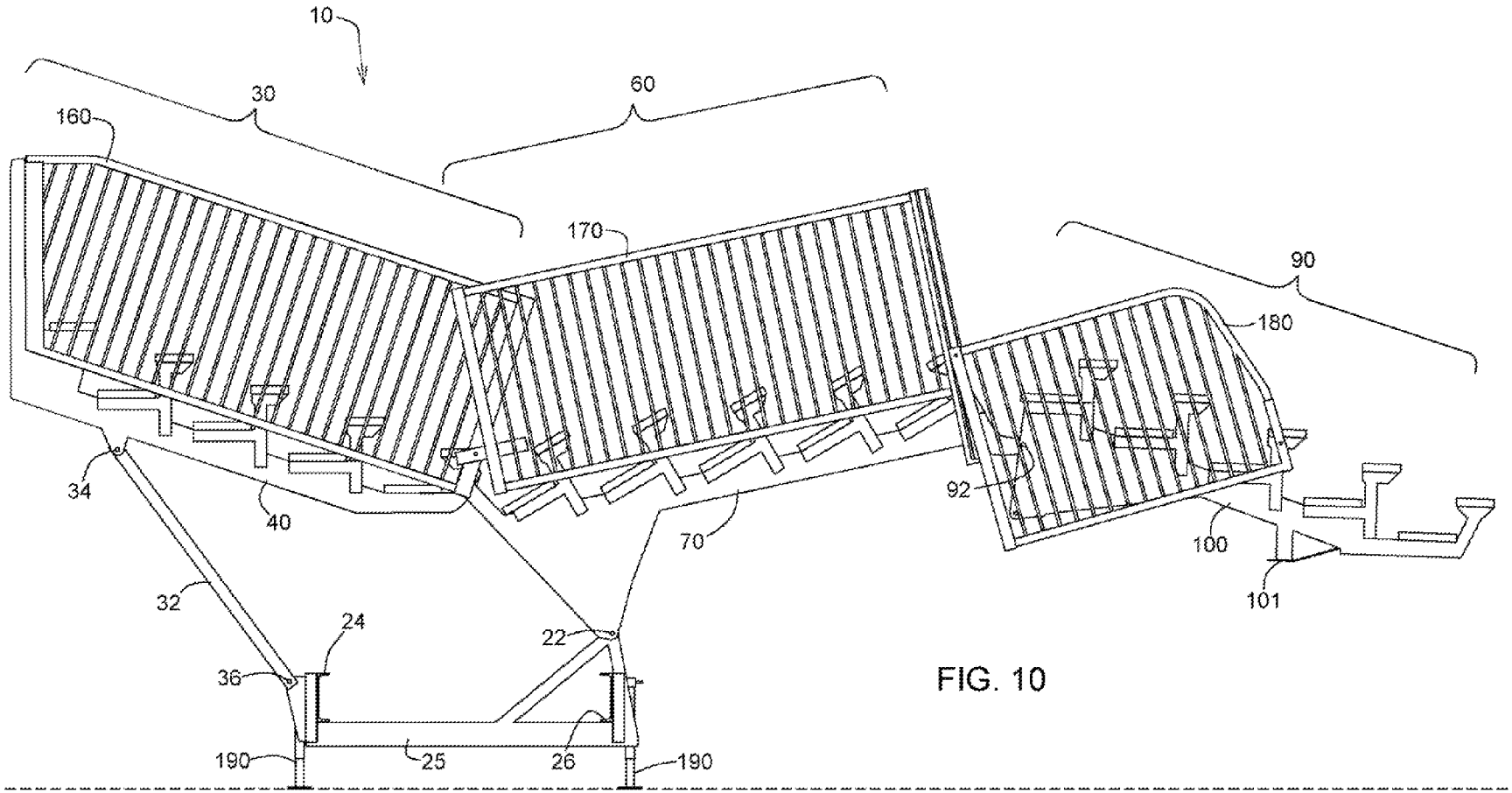
Figure 11:
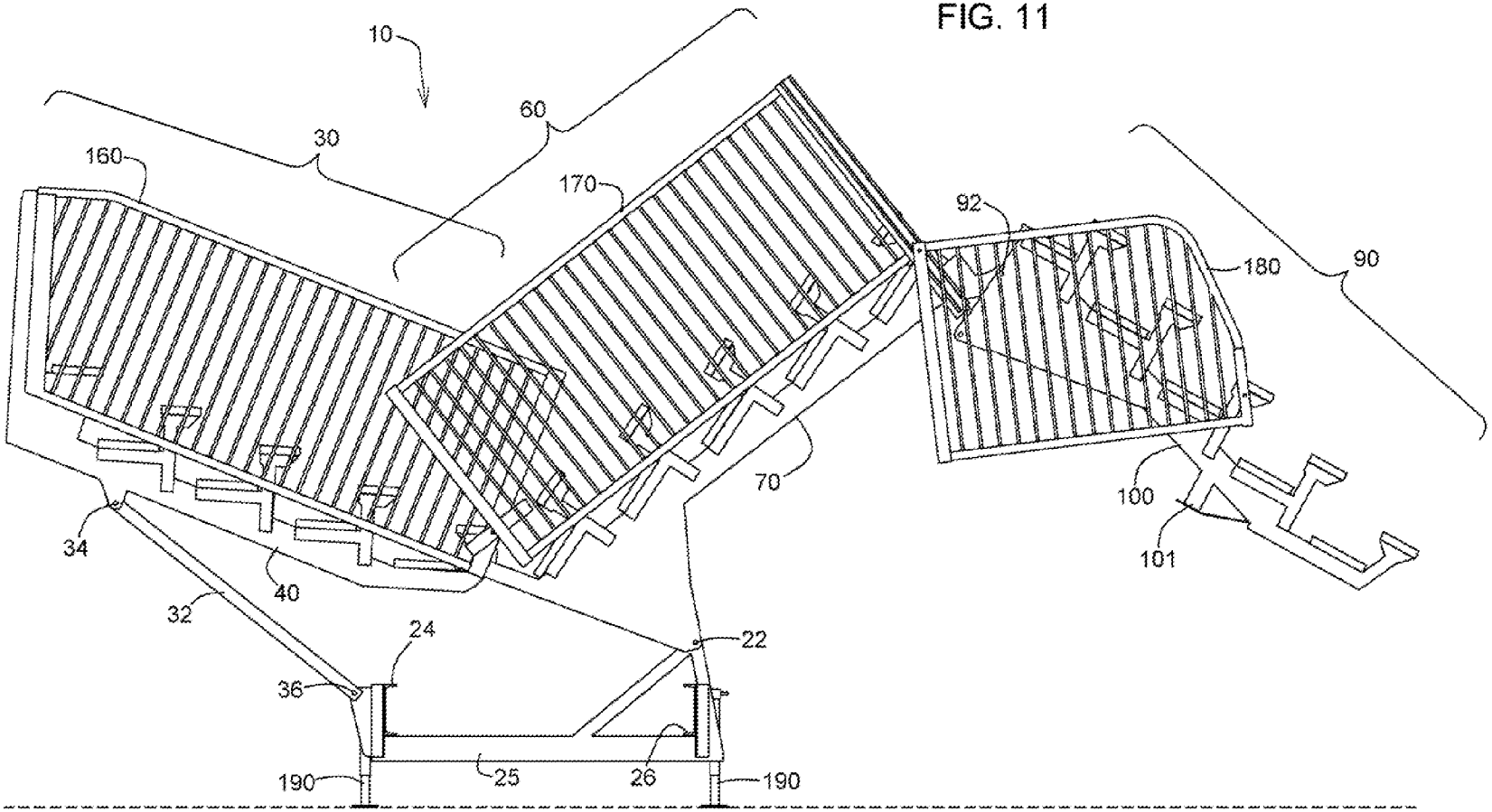
Figure 12:
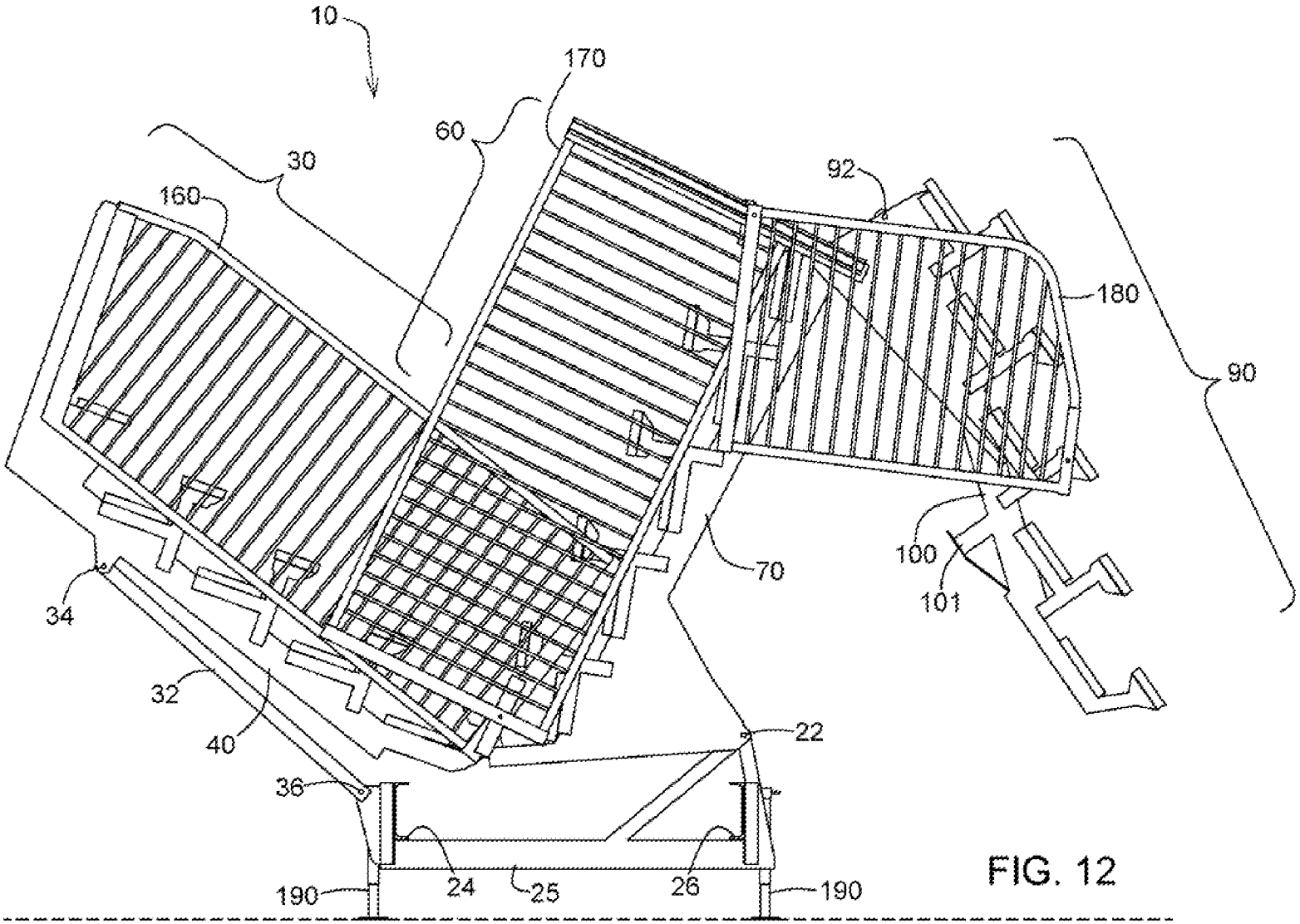
Figure 13:
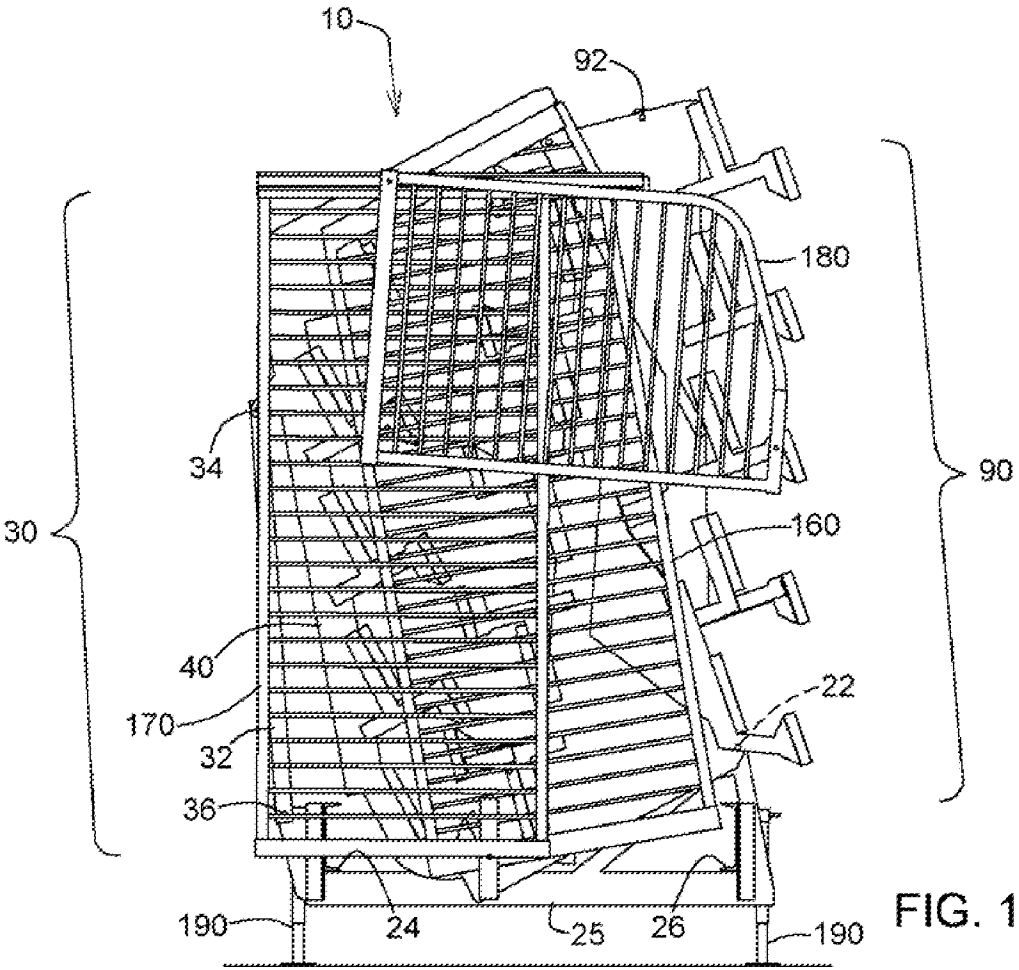

Referring now to FIGS. 8 and 13, rotation of the three tiers 30, 60, 90 ceases when the rods 142 of the hydraulic actuators 140 are fully retracted, at which time the rear struts 32 are each in an upright orientation substantially perpendicular to the underlying support structure 20, and the bleacher system 10 is in the transport position.

Furthermore, and as illustrated in FIGS. 1-3 and 9-13, the exemplary bleacher system 10 includes guardrails: left and right end guardrails 160, 160*a* associated with and secured to the upper tier 30; left and right end guardrails 170, 170*a* associated with and secured to the middle tier 60; left and right end guardrails 180, 180*a* associated with and secured to the lower tier 90; and a rear guardrail 150 that extends the length of the bleacher system 10. As illustrated in FIGS. 9-13, the end guardrail 160 is pivotally connected to the end guardrail 170, which, in turn, is pivotally connected to the end guardrail 180. Thus, as the bleacher system 10 is transitioned from the deployed position to the transport position, the end guardrails 160, 170, 180 (along with the end guardrails 160*a*, 170*a*, 180*a* at the opposite end) rotate with the respective tiers 30, 60, 90 until, in the transport position, they are essentially in a stacked relationship with respect to one another at either end of the bleacher system 10, as best illustrated in FIG. 13.

As a further (optional) refinement, in the exemplary embodiment described above with respect to FIGS. 1-13, the bleacher system 10 includes a central staircase. The individual stairs are secured to the respective seat supports 42, 72, 102 and/or foot board supports 44, 74, 104, and thus also rotate and transition from the deployed position to the transport position in the same manner as the respective seat planks 43, 73, 103 and foot planks 45, 75, 105. Furthermore, in the exemplary embodiment described above with respect to FIGS. 1-13, the bleacher system 10 also includes handrails associated with the central staircase. Each handrail is associated with and secured to a respective tier 30, 60, 90, but such handrails are only installed when the bleacher system 10 is in the deployed position and must be removed when the bleacher system 10 is transitioned to the transport position.

Of course, to transition the bleacher system 10 from the transport position back to the deployed position, the respective rods 142 of the hydraulic actuators 140 are extended. The rods 142 effectively push against the middle tier 60, causing the middle tier 60 to rotate forward (clockwise in FIGS. 7 and 12) about the main pivot point 22. As a result, the respective pivot points 92 at the pin connections between the middle tier 60 and the lower tier 90 are moved downward, and at the same time, the lower tier 90 begins rotating away from the middle tier 60 (counterclockwise in FIGS. 7 and 12) about the axis of rotation defined by the aligned pivot points 92. As the lower tier 90 rotates away from the middle tier 60, the deployment link 124 and the second, shorter deployment link 128 rotate about the pivot point 130 into an aligned position, pushing the lower tier 90 into the deployed position. At the opposite end of the middle tier 60, the respective pivot points 62 at the pin connections between the middle tier 60 and the upper tier 30 are moved upward. The upper tier 30 thus begins rotating backward (counterclockwise in FIGS. 7 and 12) about the axis of rotation defined by the aligned pivot points 34. Rotation of the three tiers 30, 60, 90 continues until the rods 142 of the hydraulic actuators 140 are fully extended, and the bleacher system 10 is in the deployed position.

Furthermore, the above-described exemplary bleacher system 10 is equipped with leveling jacks 190 that are secured to the rails 24, 26 at spaced intervals along the length of the bleacher system 10.

As a further refinement, the exemplary bleacher system may also be equipped with outrigger jacks 192, as illustrated in FIGS. 4-8, that are secured to the deployment link support structure 120 and/or the rail 26 near the deployment link support structure 120, such that each outrigger jack 192 maintains stability during deployment of the bleacher system 10. Specifically, as the bleacher system 10 transitions from the transport position to the deployed position, the center of gravity of the bleacher system 10 moves outward in the direction of deployment. The outrigger jacks 192 are extended from the support structure 20 in the direction of deployment and thus account for this change in the center of gravity, preventing the bleacher system 10 from becoming unstable and/or overturning during the transition between the transport position and the deployment position, or vice versa.

Figure 31:
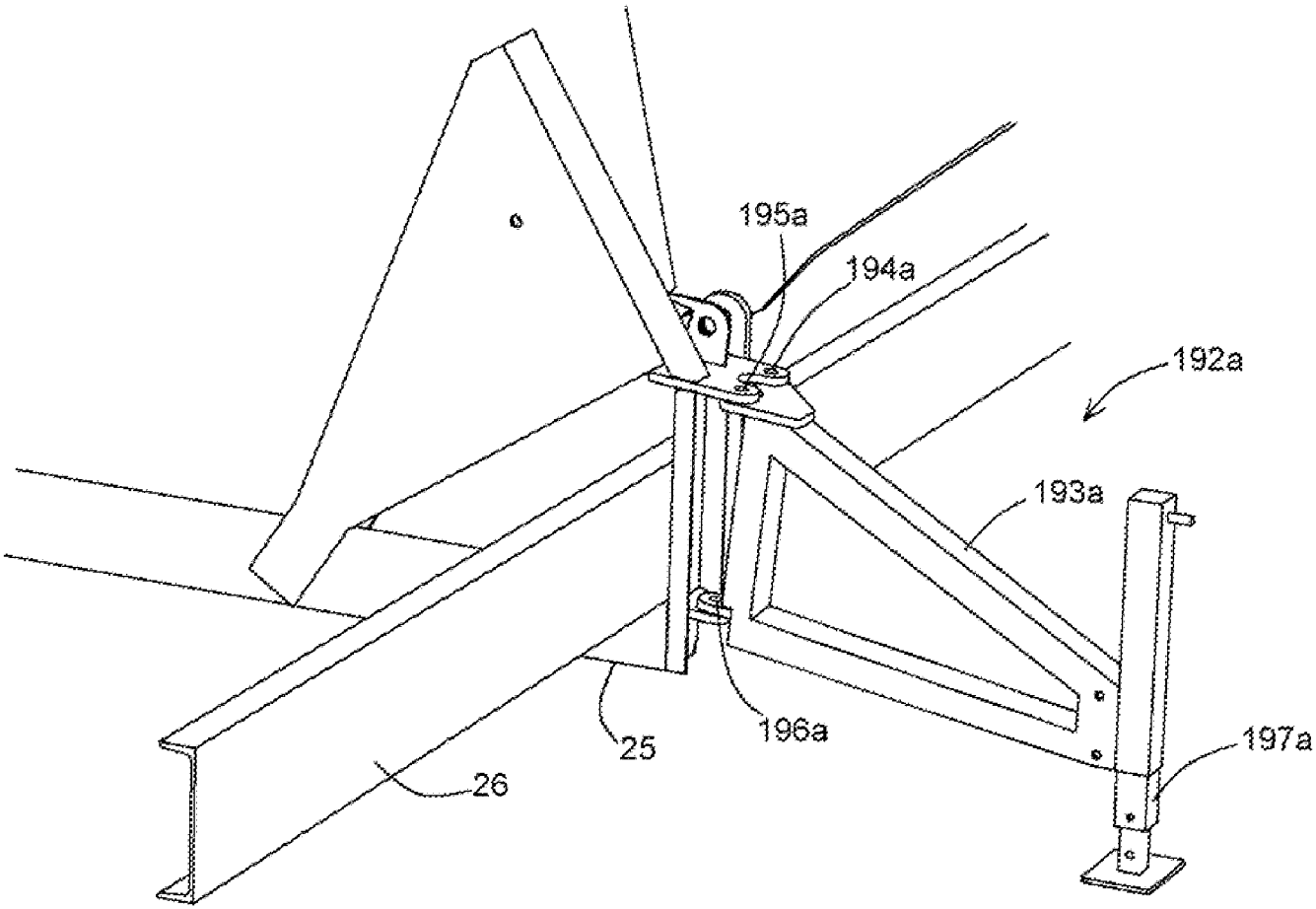
FIG. 31 is a perspective view of an exemplary outrigger jack for use with the exemplary 15-row bleacher system of FIG. 1 in a deployed position.
Figure 32:
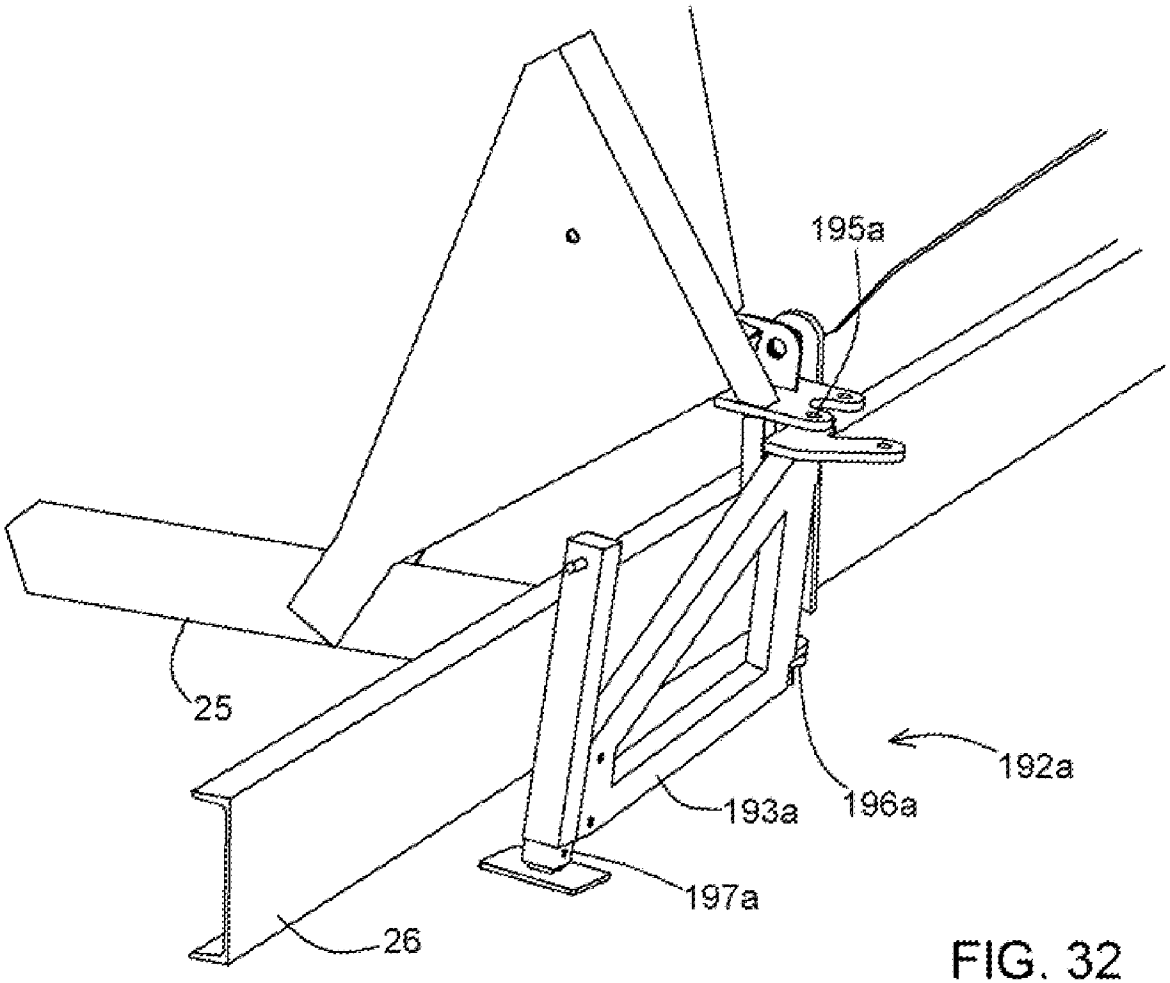
FIG. 32 is a perspective view of an exemplary outrigger jack for use with the exemplary 15-row bleacher system of FIG. 1 in a storage position.

FIGS. 31 and 32 illustrate one contemplated embodiment of an outrigger jack 192*a* for use with the bleacher system 10 of the present invention. In this exemplary embodiment, the outrigger jack 192*a* is pivotally connected to the rail 26 of the support structure 20, such that it can be moved between a deployed position (FIG. 31) and a storage position (FIG. 32). In this regard, the outrigger jack 192*a* includes a generally triangular base structure 193*a* that includes upper and lower pivot brackets for pivotally connecting the base structure 193*a* to the rail 26 and support structure 20. Specifically, a pin 195*a* is inserted through a first bracket extending from the rail 26 and then through the upper pivot bracket of the base structure 193*a*. Similarly, a pin 196*a* is inserted through a second bracket extending from the rail 26 and then through the lower pivot bracket of the base structure 193*a*. Thus, the base structure 193*a* can pivot and swing between the deployed position and the storage position about the axis defined by these pins 195*a*, 196*a*. Finally, in this exemplary embodiment, and as illustrated in FIG. 31, a locking pin 194*a* is selectively inserted through the first bracket extending from the rail 26 and then through the upper pivot bracket of the base structure 193*a* in order to fix the outrigger jack 192*a* in the deployed position.

Referring still to FIGS. 31 and 32, a telescoping strut (or jack) 197*a* is then secured to the distal end of the base structure 193*a*, and a foot is pivotally connected to the telescoping strut 197*a*, such that the telescoping strut 197*a* and the foot 198*a* can be readily manipulated into full engagement with the underlying ground surface.

Again, FIGS. 31-32 illustrate only one contemplated embodiment of an outrigger jack 192*a* for use with the bleacher system 10 of the present invention, and it is contemplated that various other outrigger jacks or similar mechanisms could be used to stabilize the bleacher system 10 without departing from the spirit and scope of the present invention.

As a further refinement, in the exemplary embodiment illustrated in FIGS. 1-13, the bleacher system 10 is also equipped with landing posts 101 which are integral with and extend from each girder 100 of the lower tier 90. These landing posts 101 engage the underlying ground surface when the bleacher system 10 is in the deployed position.

FIGS. 14-17 are various views of an exemplary 10-row bleacher system 210 made in accordance with the present invention. As shown in FIGS. 14-17, there are only two tiers 230, 260 in this exemplary embodiment. These two tiers 230, 260 are mounted to an underlying support structure 220, which, like the bleacher system 10 described above with respect to FIGS. 1-13, includes two parallel rails 224, 226 that are spaced from one another and extend the length of the bleacher system 210. Multiple cross members 225 extend between and connect the two parallel rails 224, 226 along the length of the bleacher system 210. Wheels and an associated suspension system (collectively indicated by reference numeral 228 in FIGS. 16 and 17) are mounted to the rails 224, 226 to facilitate transport of the bleacher system 210, and again, it is preferred that the bleacher system 210 is equipped with the necessary hitch, suspension, and other equipment as necessary to satisfy relevant Department of Transportation ("DOT") requirements so that the bleacher system, when in the transport position, can be towed behind a truck. In any event, each tier 230, 260 is then generally constructed of multiple girders at spaced intervals that are operably connected to the underlying support structure 220.

Figure 17:
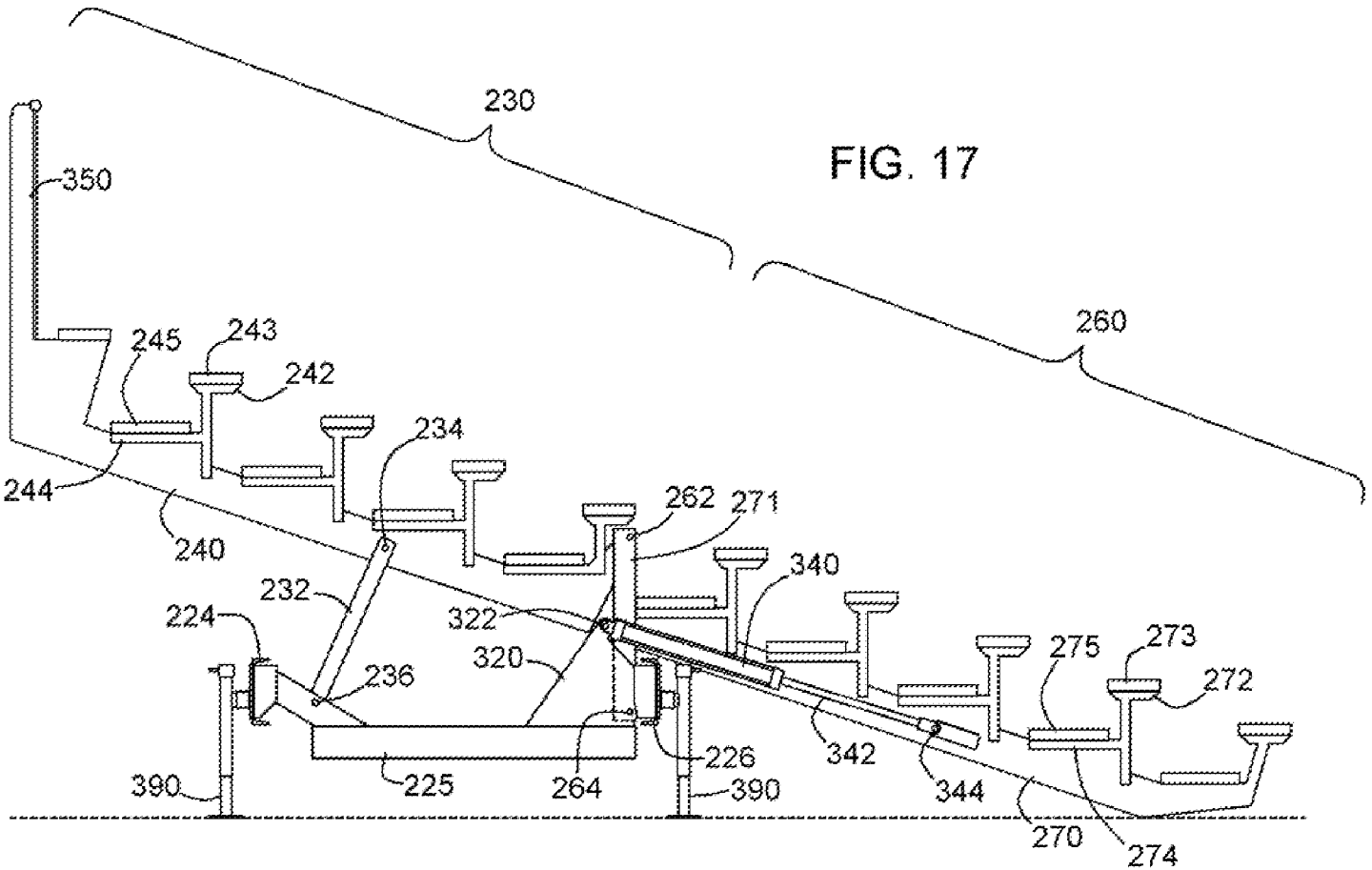
FIG. 17 is a side sectional view of the exemplary bleacher system of FIG. 14, but with certain components, including the end guardrails, removed for clarity.
Figure 18:
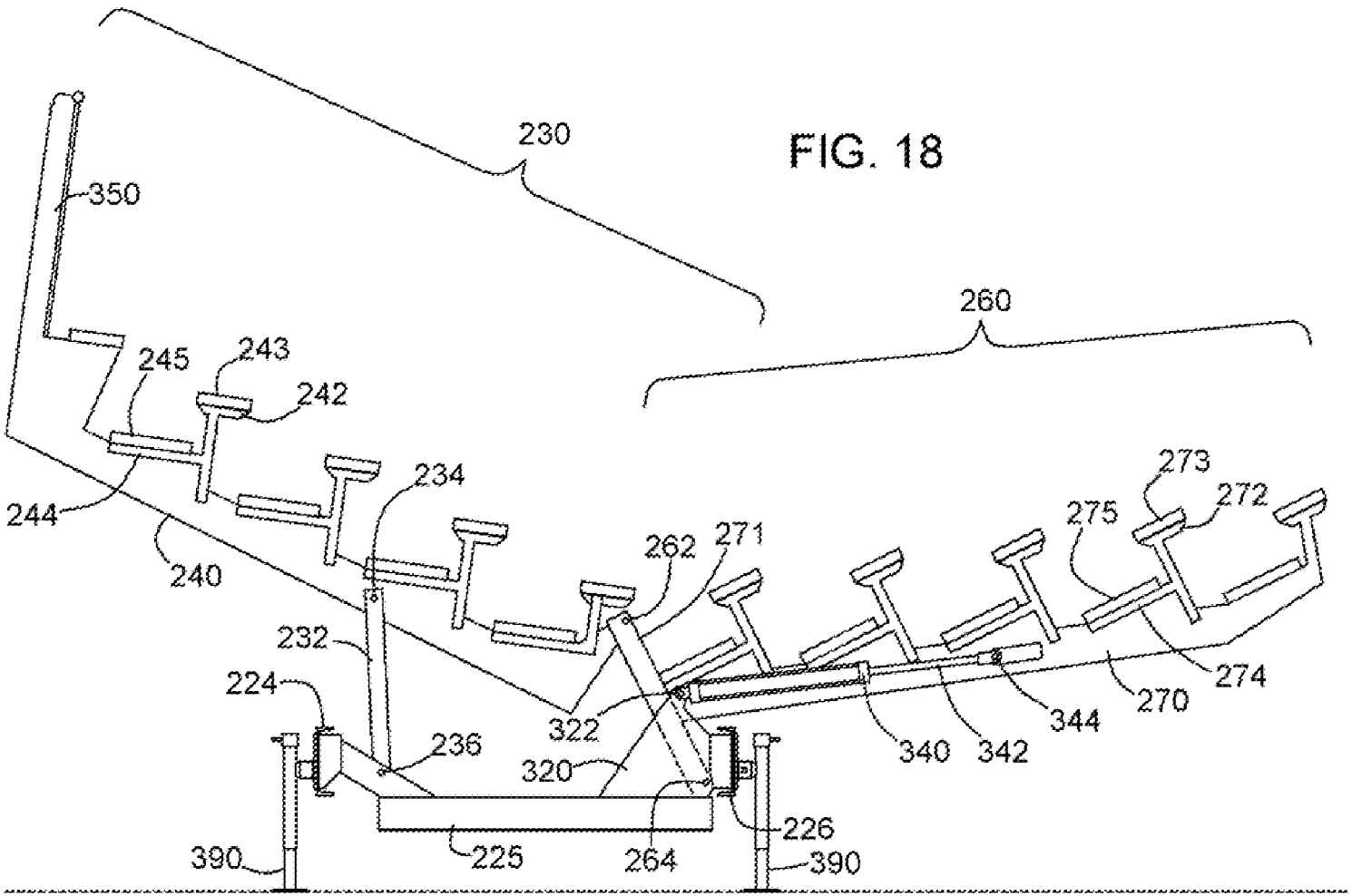
FIG. 18 is a side sectional view similar to FIG. 14, illustrating the bleacher system as it starts to transition from the deployed position to the transport position.
Figure 19:
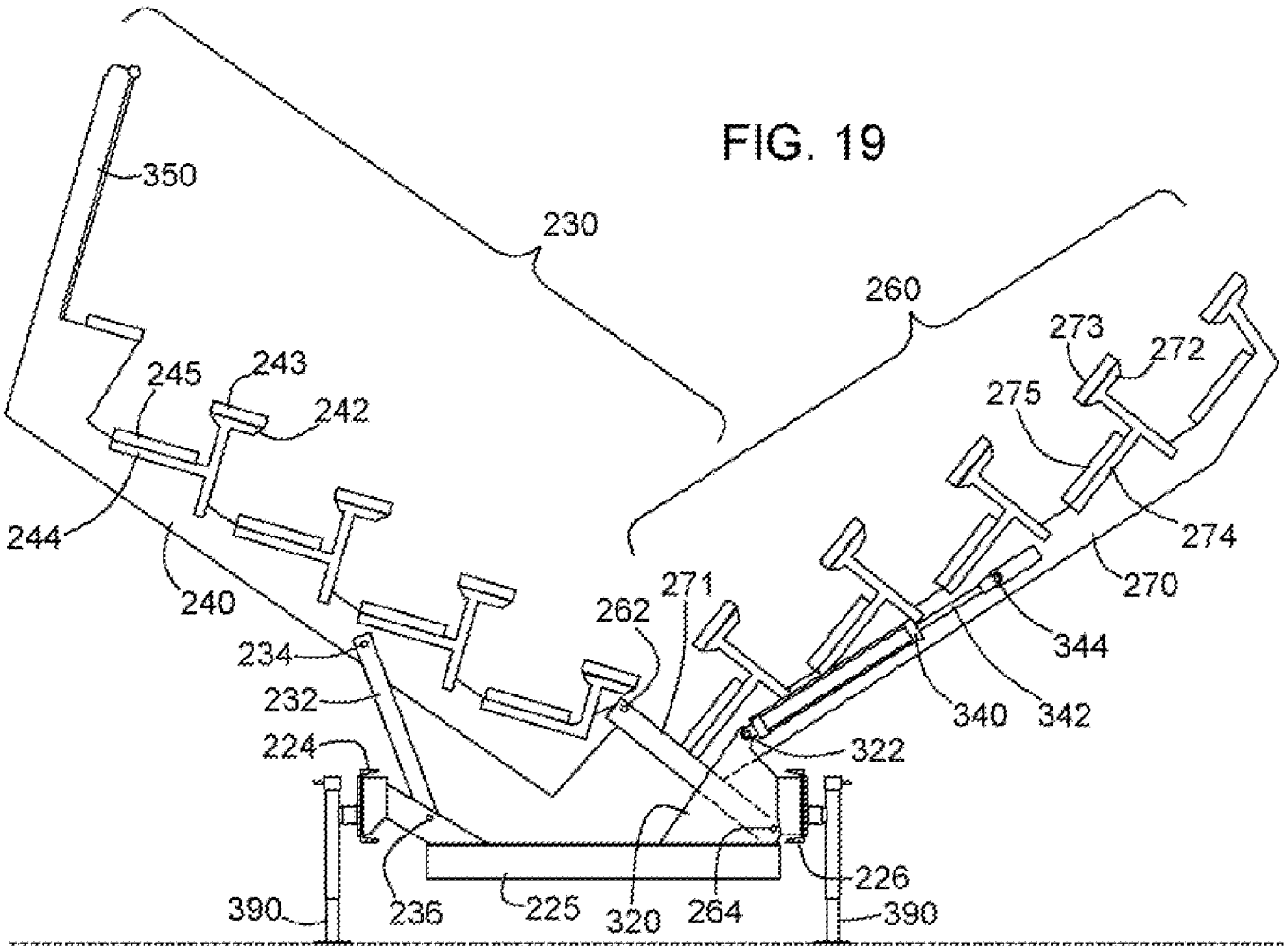
FIG. 19 is a side sectional view similar to FIG. 14, illustrating the bleacher system as it continues to transition from the deployed position to the transport position.
Figure 20:
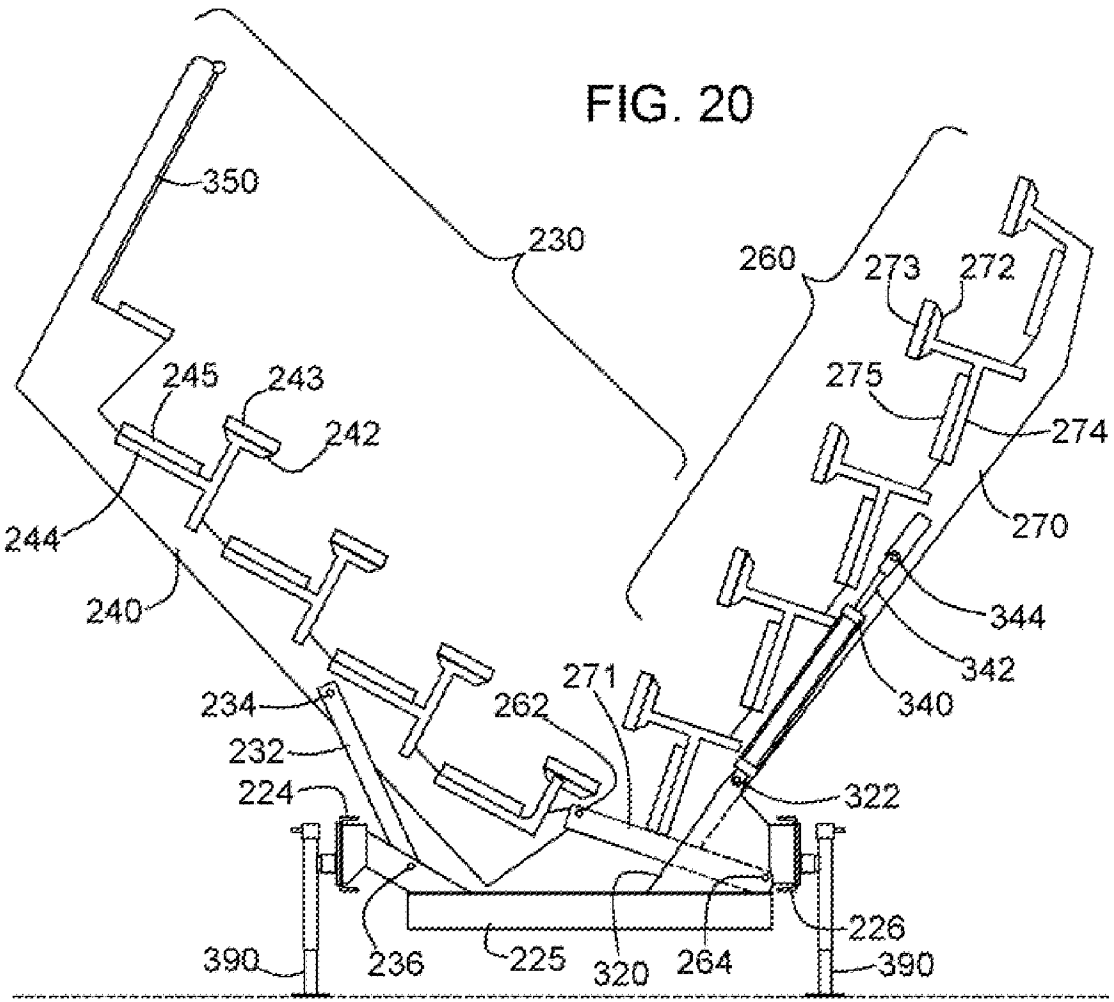
FIG. 20 is a side sectional view similar to FIG. 14, illustrating the bleacher system as it continues to transition from the deployed position to the transport position.

Referring now to FIG. 17, the upper tier 230 is constructed from multiple girders 240 at spaced intervals. In the exemplary embodiment, five such girders 240 are spaced at approximately six-foot intervals. Each girder 240 supports multiple seat supports 242 and foot board supports 244, with respective seat planks 243 and foot planks 245 then being secured to the respective seat supports 242 and foot board supports 244 and extending along the length of the bleacher system 210 over such seat supports 242 and foot board supports 244.

Similarly, the lower tier 260 is constructed from multiple girders 270 at spaced intervals. Each girder 270 supports multiple seat supports 272 and foot board supports 274, with respective seat planks 273 and foot planks 275 then being secured to the respective seat supports 272 and foot board supports 274 and extending along the length of the bleacher system 210 over such seat supports 272 and foot board supports 274.

Referring still to FIG. 17, the girder 240 of the upper tier 230 is connected to a rear strut 232 by a pin connection defining a pivot point 234. In this regard, as should be clear from the perspective views of FIGS. 14 and 15, there are actually multiple rear struts 232 and associated pivots points 234, one associated with each girder 240 along the length of the bleacher system 210. The pivot points 234 defined by the respective pin connections are aligned and effectively define an axis of rotation along the length of the bleacher system 210. Each rear strut 232 is thus pivotally connected to a girder 240 of the upper tier 230 at a first end, and then is connected to the underlying support structure 220 by a pin connection defining another pivot point 236.

Referring still to FIG. 17, the upper tier 230 is also connected to the lower tier 260 by a pin connection defining a pivot point 262. Again, there are actually multiple such pin connections and associated pivot points 262 that are aligned along the length of the bleacher system 210 that effectively define an axis of rotation along the length of the bleacher system 210. Specifically, each girder 270 of lower tier 260 includes a vertical extension 271. The pin connection defining the pivot point 262 between the upper tier 230 and the lower tier 260 at each girder 270 is at a first end of this vertical extension 271, while the opposite end of the vertical extension is connected by a pin connection defining a pivot point 264 to the underlying support structure 220.

Now, with respect to the transition of the bleacher system 210 from the transport position to the deployed position, and vice versa, a hydraulic actuator 340 (or similar mechanical or electromechanical actuator) is connected to a plate 320 (which is secured to and extends from the support structure 220) at a first end by a pin connection defining a pivot point 322. The rod 342 of the hydraulic actuator 340 is then connected to the lower tier 260 by a pin connection defining a pivot point 344.

Because of this construction, the exemplary bleacher system 210 can be readily transitioned from the transport position to the deployed position by extending the hydraulic actuators 340.

Referring now to FIGS. 17-22 and 23-27, in operation, when transitioning from the deployed position to the transport position, each hydraulic actuator 340 is activated in unison, and the respective rods 342 of the hydraulic actuators 340 begin to retract. As the rods 342 begin to retract, the lower tier 260 begins rotating backward (counterclockwise in FIGS. 18 and 24) about the axis of rotation defined by the aligned pivots points 264. As a result, the respective pivot points 262 at the pin connections between the upper tier 230 and the lower tier 260 are moved downward, and thus, the upper tier 230 begins rotating toward the lower tier 260 (clockwise in FIGS. 18 and 24) about the axis of rotation defined by the aligned pivot points 234. At the same time, the rear struts 232 also begin rotating backward (counterclockwise in FIGS. 18 and 24) about the axis of rotation defined by the aligned pivot points 236. In other words, the extension of the rods 342 of the hydraulic actuators 340 causes the lower tier 260 to pivot about the pivot point 264 relative to the support structure 220 in a first direction, while causing the upper tier 230 to pivot about a pivot point 236 relative to the support structure 20 in an opposite direction.

Figure 21:
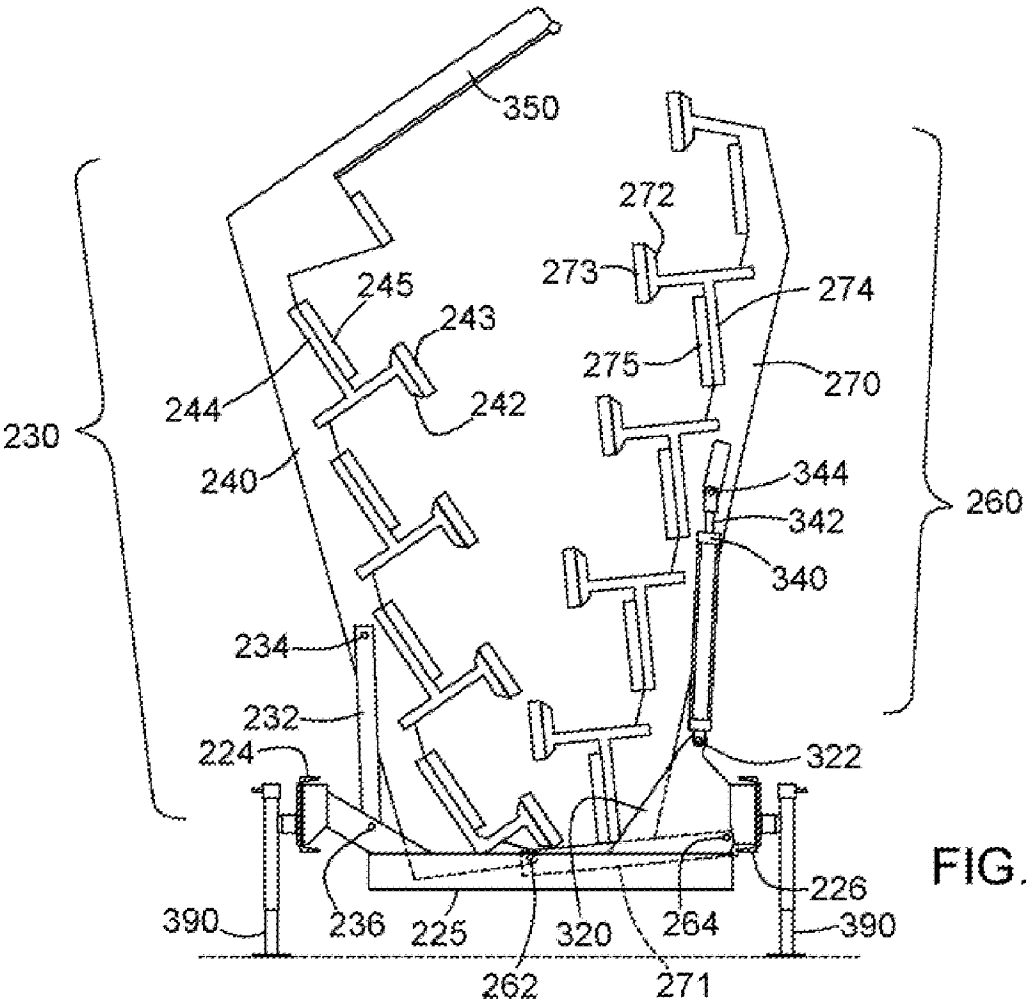
FIG. 21 is a side sectional view similar to FIG. 14, illustrating the bleacher system in the transport position.
Figure 27:
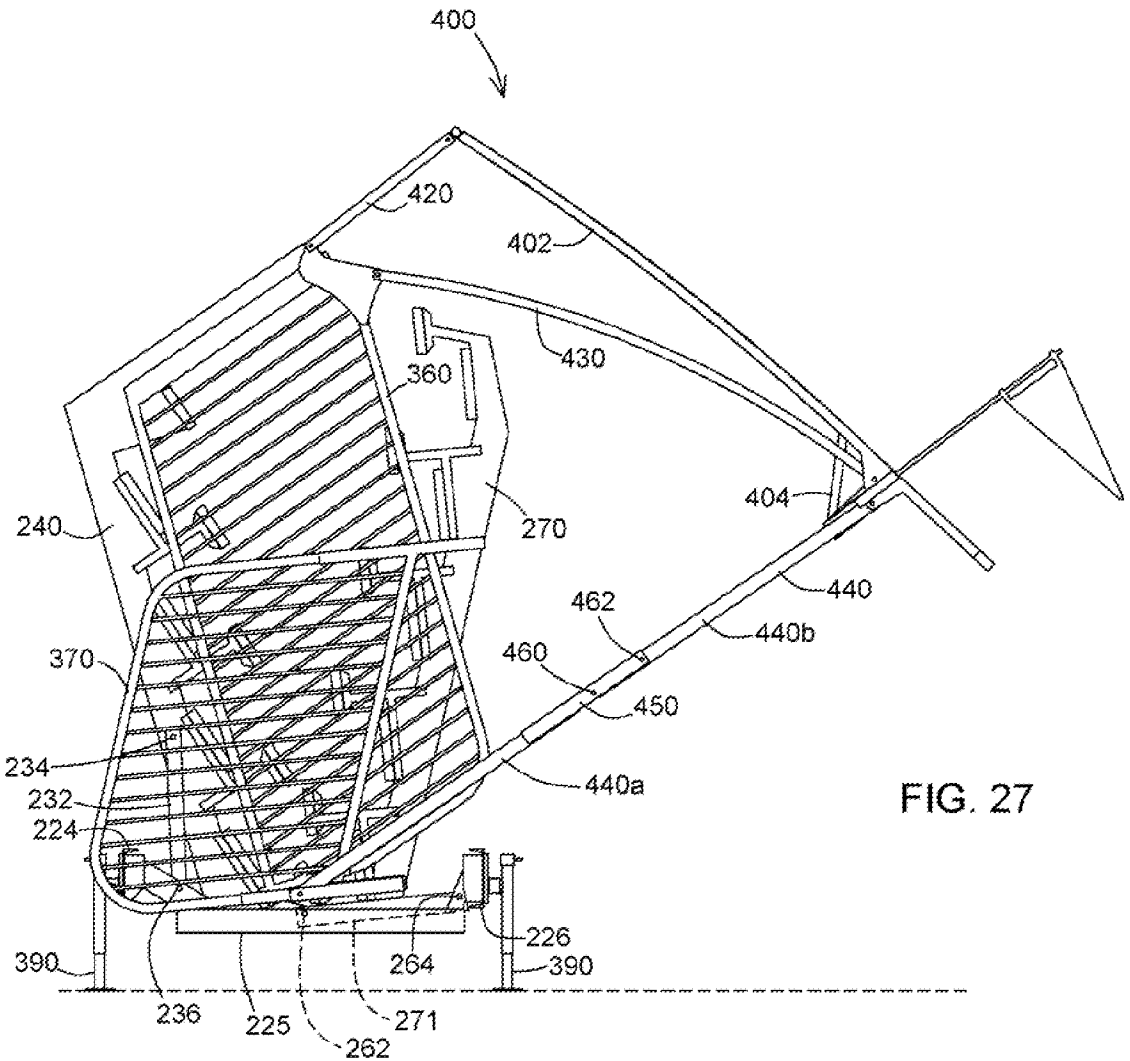

Such simultaneous rotation of the upper tier 230 and the lower tier 260 continues as the rods 342 of the hydraulic actuators 340 retract. Referring now to FIGS. 21 and 27, rotation of the upper tier 230 and the lower tier 260 ceases when the rods 342 of the hydraulic actuators 340 are fully retracted, and the bleacher system 210 is in the transport position.

Figure 21A:
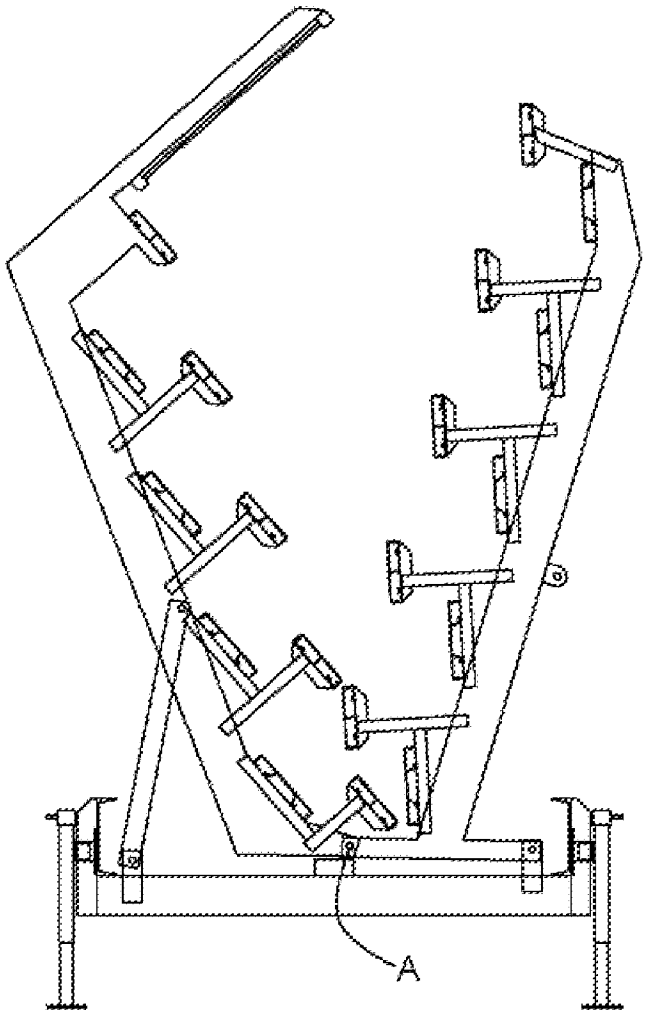
FIG. 21a (PRIOR ART)
FIG. 21*a* is a side sectional view of a prior art bleacher system in the transport position.
Figure 22:
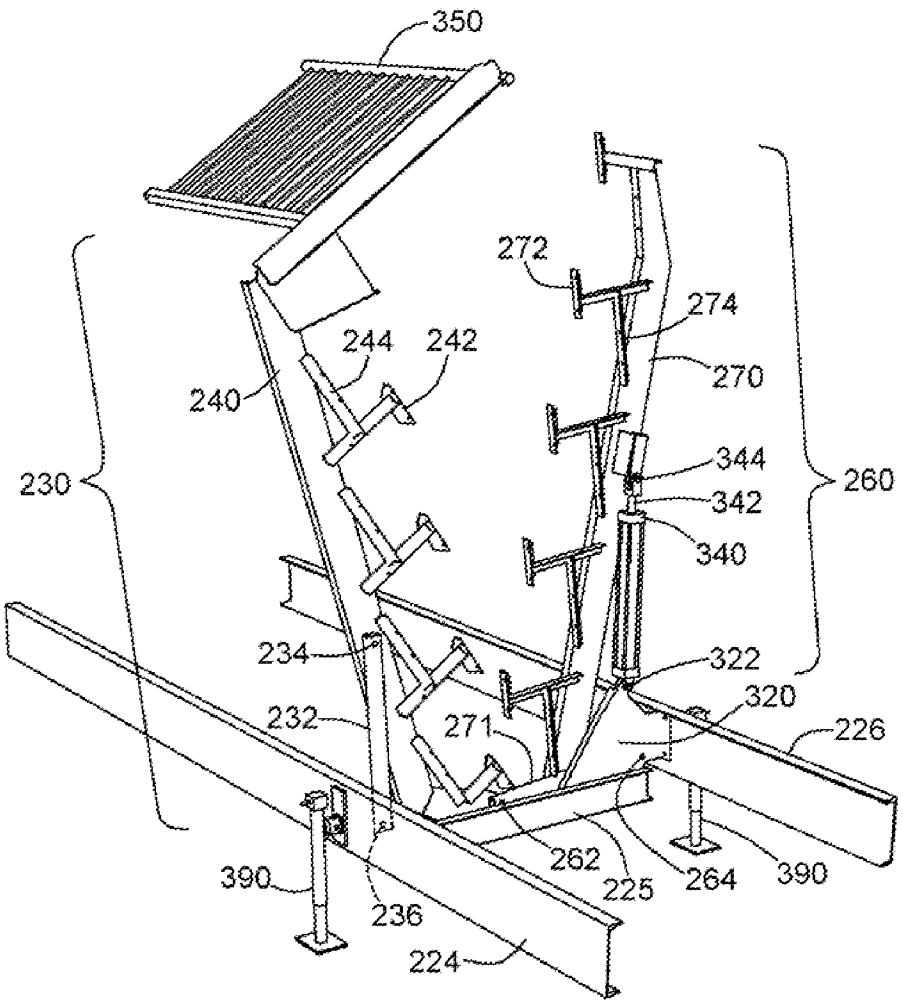
FIG. 22 is a perspective view of a portion of the exemplary bleacher system of FIG. 14 in the transport position.
Figure 23:
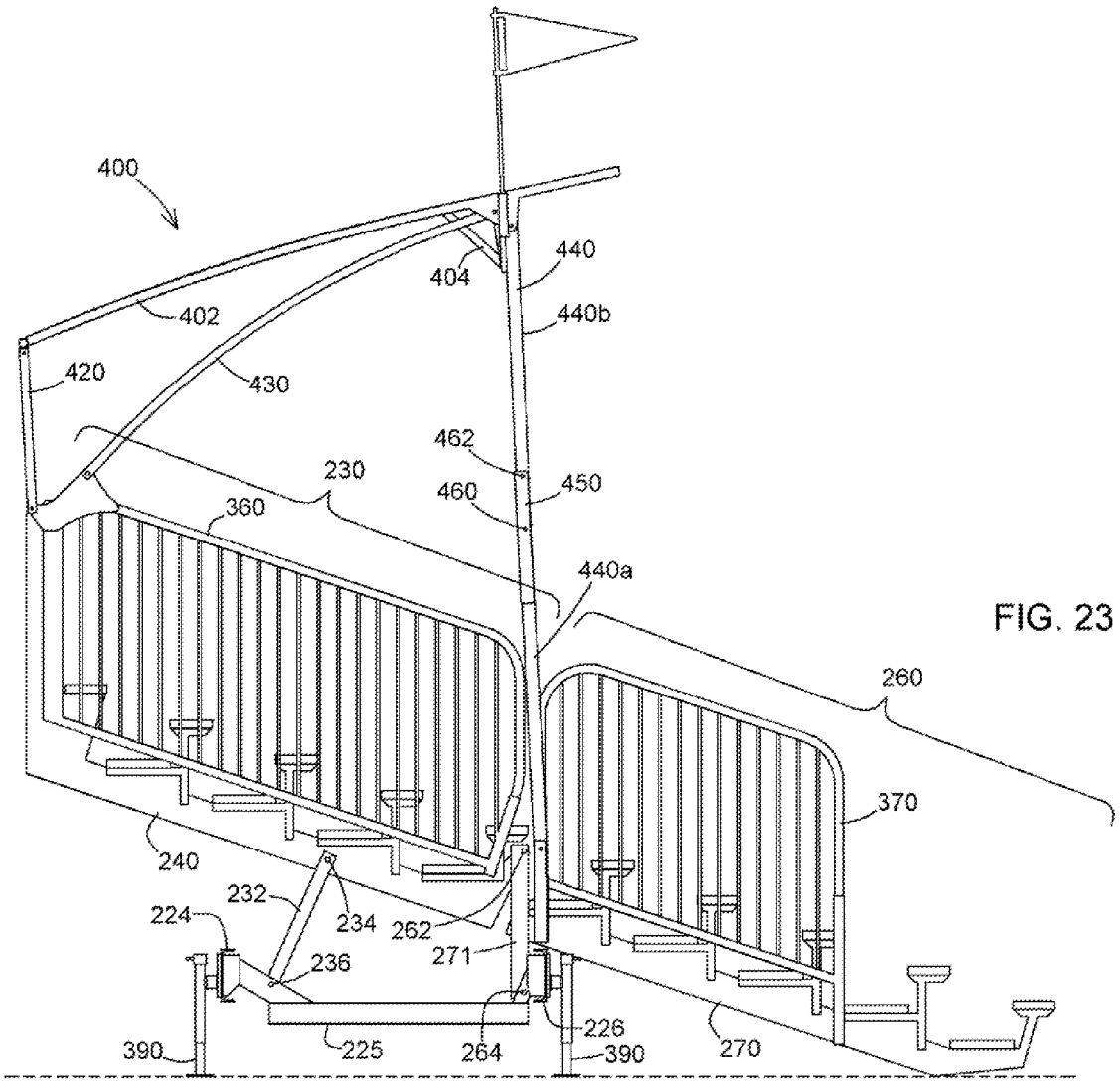
FIGS. 23-27 correspond to FIGS. 17-21, but include the end guardrails, while again illustrating the bleacher system as it transitions from the deployed position to the transport position.
Figure 24:
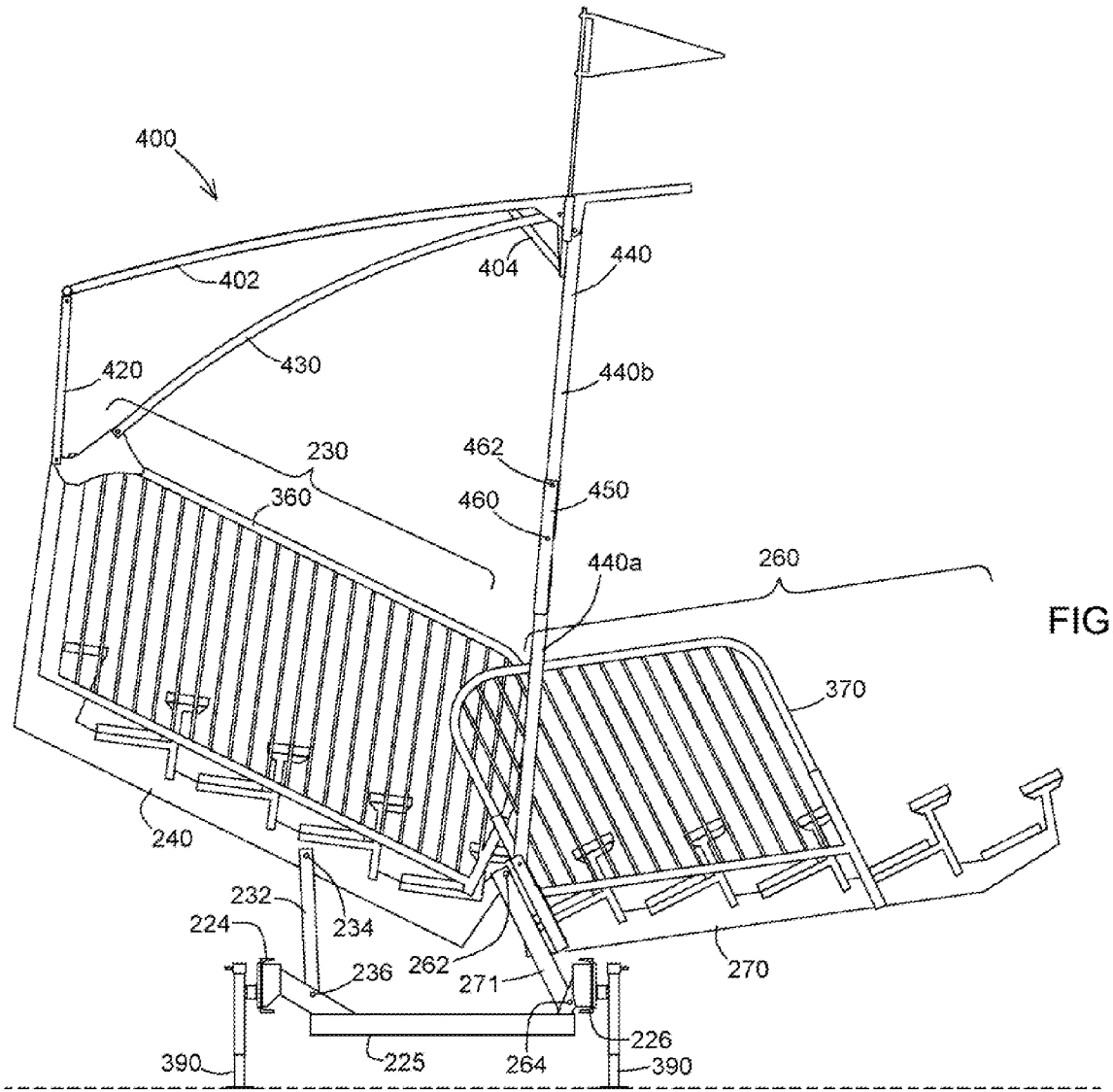
Figure 25:
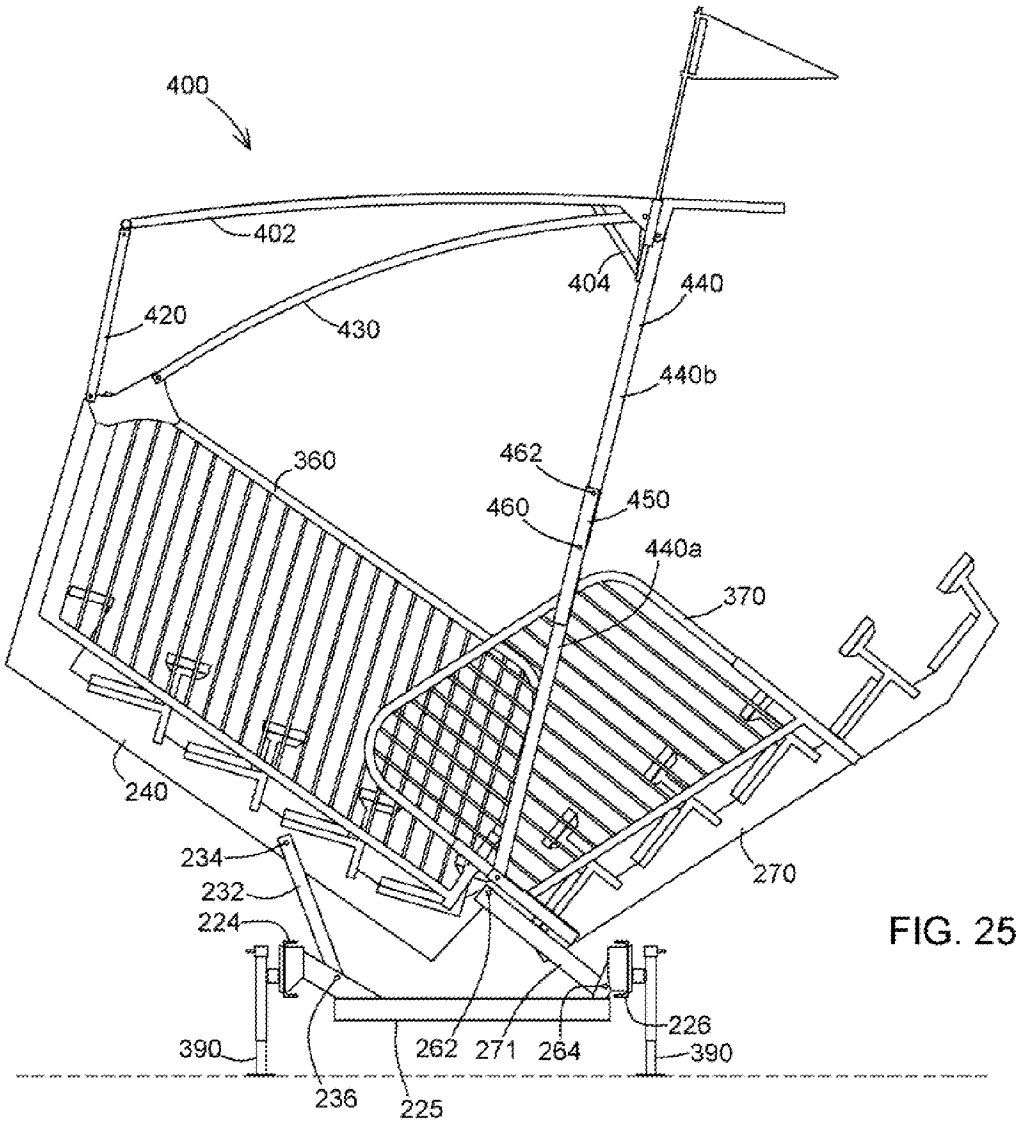
Figure 26:
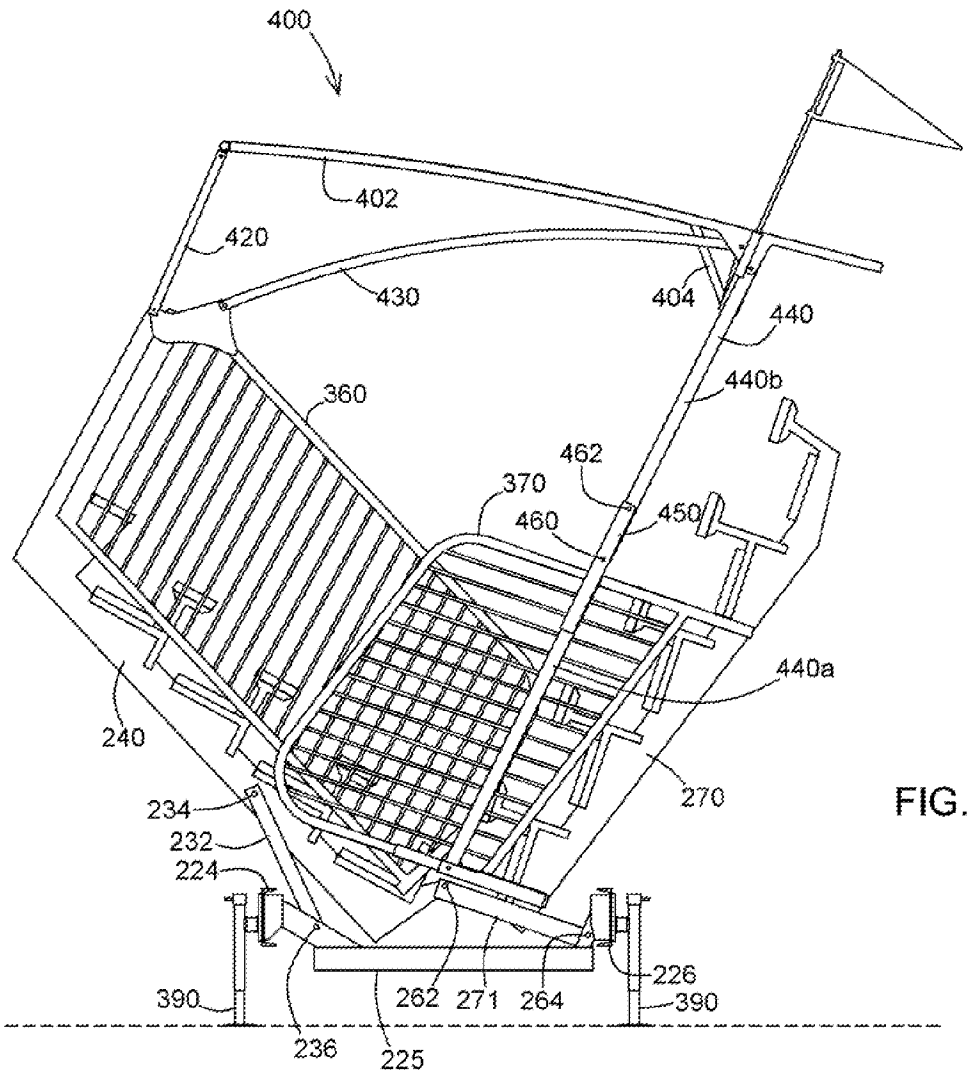

Furthermore, the views of the exemplary 10-row bleacher system 210 in FIGS. 17-21 and 22-27 also assist in demonstrating another benefit of the present invention. Specifically, as a result of the construction, it is possible to increase the number of rows in the bleacher system 210 or increase the spacing or leg room (pitch) from one seat row to the next, but without increasing the overall height of the bleacher system 210 in the transport position. Specifically, the pivot connection between the upper tier 230 and the lower tier 260 falls between the cross members 225 that extend between the rails of the underlying support structure 220 when the bleacher system 210 is in the transport position. In other words, the pivot points 262 are at or below an uppermost surface of the respective cross members 225. Thus, some of the structure of the upper and/or lower tiers 230, 260 can extend below and fit between the cross members 225, allowing for an increase in the spacing or leg room (pitch) from one seat row to the next or a lower overall trailer height. This is readily contrasted to prior art constructions in which the pivot points between the respective upper and lower tiers 230, 260 were positioned substantially above an uppermost surface of the cross members 225. For example, reference is made to FIG. 21*a*, which is a view similar to FIG. 21, but illustrates a prior art bleacher system in the transport position in which the pivot point A is clearly elevated above the cross member. This same benefit is also realized in the exemplary 15-row bleacher system described above with respect to FIGS. 1-16, in which the pivot point 62 between the upper tier 30 and the middle tier 60 is approximately at the level of the top surfaces of the cross members 25 (see FIG. 8), with portions of the girders 40, 70 of the upper and lower tiers 30, 60 below the top surfaces of the cross members 25.

Furthermore, and as illustrated in FIGS. 14-16 and 23-27, the mobile bleacher system 210 includes guardrails: left and right end guardrails 360, 360*a* associated with and secured to the upper tier 230; left and right end guardrails 370, 370*a* associated with and secured to the lower tier 260; and a rear guardrail 350 that extends the length of the mobile bleacher system 10. As the bleacher system 210 is transitioned from the deployed position to the transport position, the end guardrails 360, 370 (along with the end guardrails 360*a*, 370*a* at the opposite end) are also transitioned from a deployed position to a transport position in which they are essentially in a stacked relationship with respect to one another, as best illustrated in FIG. 27.

As a further (optional) refinement, in the exemplary embodiment described above with respect to FIGS. 14-27, the bleacher system 210 includes a central staircase. The individual stairs are secured to the respective seat supports 242, 272 and/or foot board supports 244, 274 and thus also rotate and transition from the deployed position to the transport position in the same manner as the respective seat planks 243, 273 and foot planks 245, 275. Furthermore, in the exemplary embodiment described above with respect to FIGS. 14-27, the mobile bleacher system 10 also includes handrails associated with the central staircase. Each handrail is associated with and secured to a respective tier 30, 60, 90, but such handrails are only installed when the bleacher system 10 is in the deployed position and must be removed when the bleacher system 10 is transitioned to the transport position.

Figure 28:
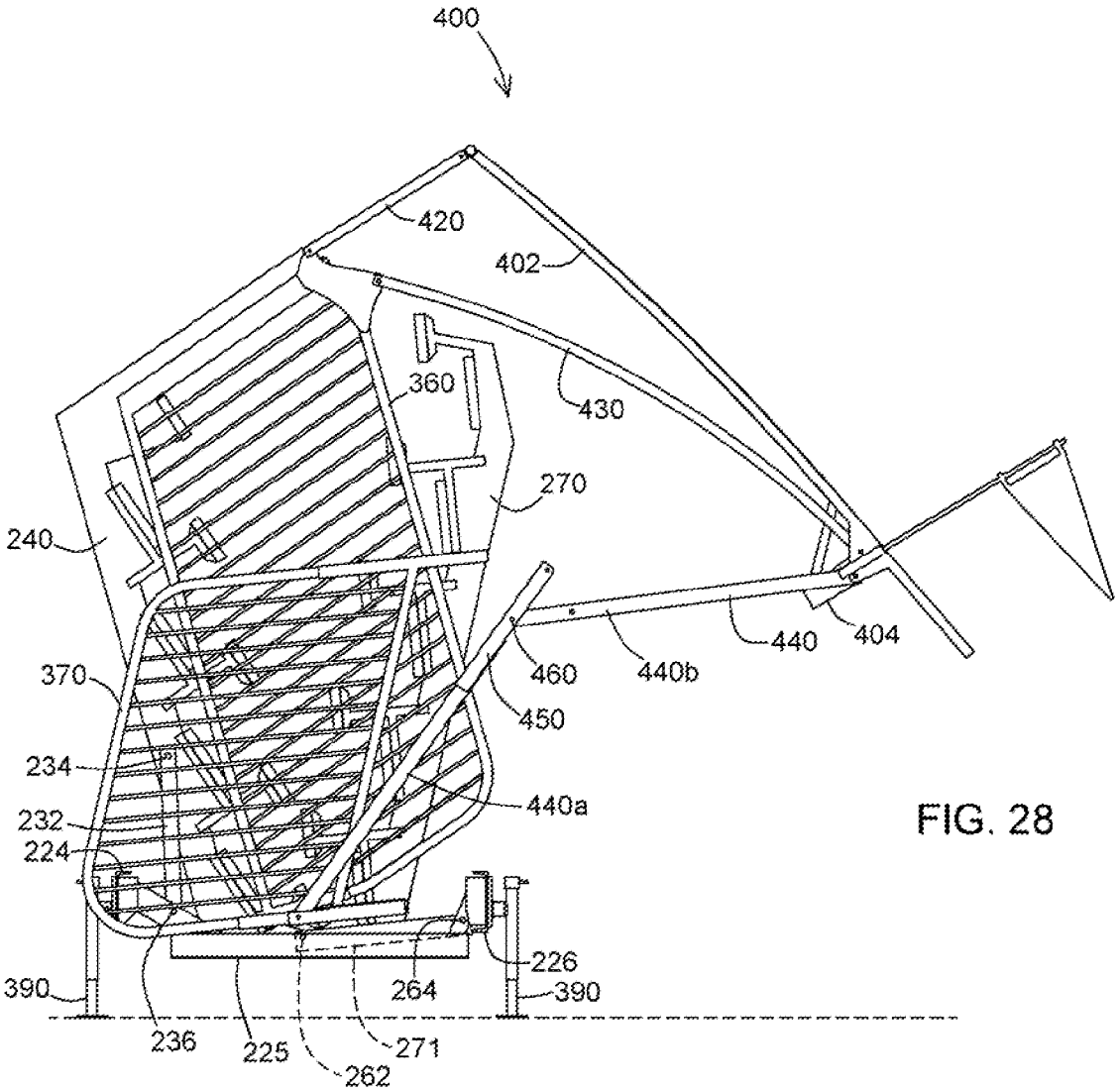
FIGS. 28-30 are additional side views of the exemplary bleacher system of FIG. 14 in the transport position, further illustrating the transition of the canopy assembly from the deployed position to the transport position.
Figure 29:
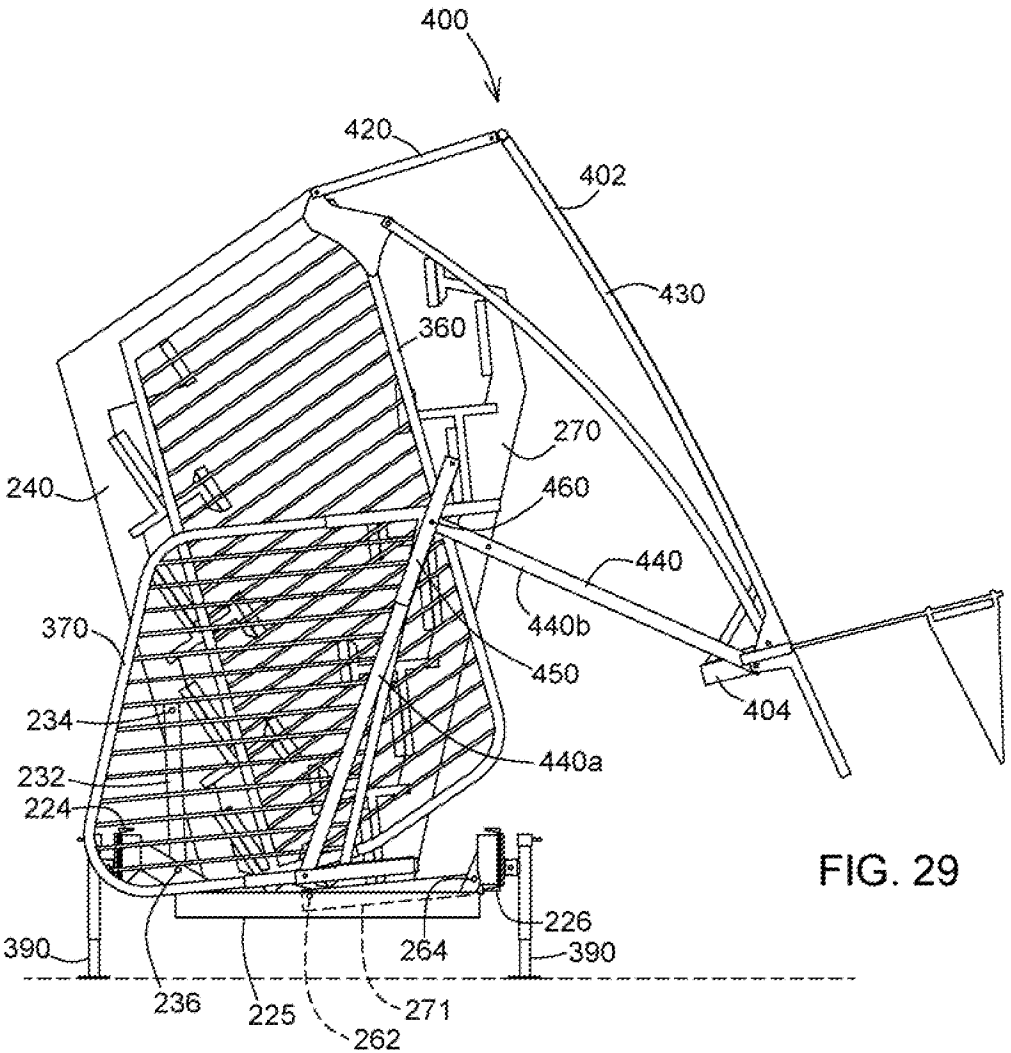
Figure 30:
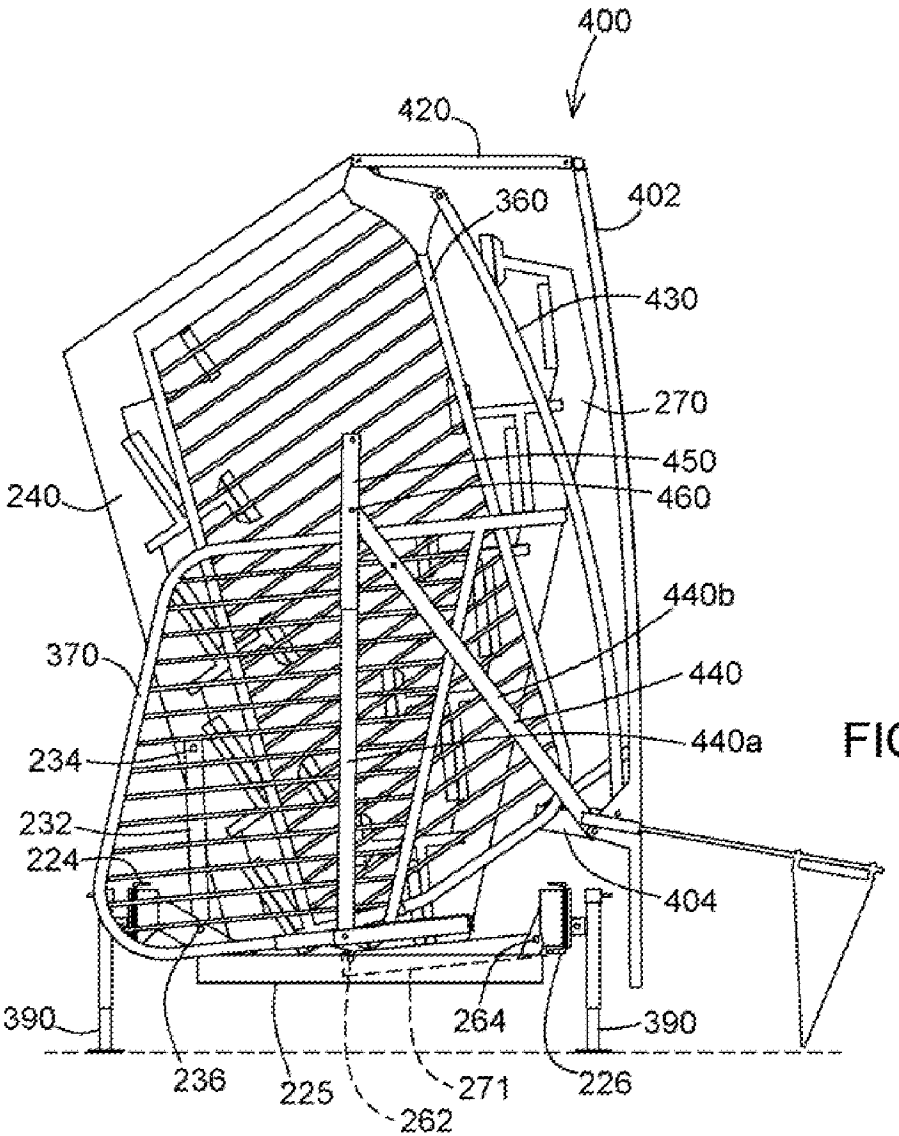

Also, as illustrated in FIGS. 14-27 and the additional views of FIGS. 28-30, the exemplary bleacher system 210 can optionally include a canopy assembly 400 that can be collapsed for transport. Because individuals seated in bleachers are often exposed to the sun and weather, it is often desirable to incorporate such a canopy assembly 400 into a bleacher system. Of course, since the bleacher system 210 illustrated in FIGS. 14-27 and the additional views of FIGS. 28-30 is designed for ready transport, the canopy assembly 400 should also be easy to transition from the transport position to the deployed position, and vice versa. In this exemplary embodiment, the canopy assembly 400 includes an overhead frame (generally indicated by reference number 402) with a front truss 404, and a canopy 410 (such as a sunshade, weather, or other canopy) is stretched over and supported by this overhead frame 402. The canopy assembly 400 further includes multiple rear canopy struts 420 that are pivotally connected to the rear of the overhead frame 402 and pivotally connected to the rear guardrail 350 of the bleacher system 210. The rear canopy struts 420 maintain the proper position of the rear edge of the canopy 410 relative to the upper tier 230 in the deployed position. The canopy assembly 400 further includes two diagonal support struts 430, one at each end of the bleacher system 210, with each diagonal support strut 430 being pivotally connected to one of the end guardrails 360, 360*a* at a first end and pivotally connected to an end of the front truss 404 of the overhead frame 402 at a second end. Finally, the canopy assembly 400 includes two vertical support struts 440, one at each end of the bleacher system 210, with each vertical support strut 440 being pivotally connected to the front truss 404 of the overhead frame 402 at a first end and pivotally connected to the lower tier 260 at a second end. These vertical support struts 440 maintain the proper position of the front edge of the canopy 410 relative to the lower tier 260 in the deployed position, but also, in cooperation with the rear canopy struts 420 and the diagonal support struts 430, allow sufficient space for the bleacher system 210 to transition from the deployed position to the transport position.

Figure 14:
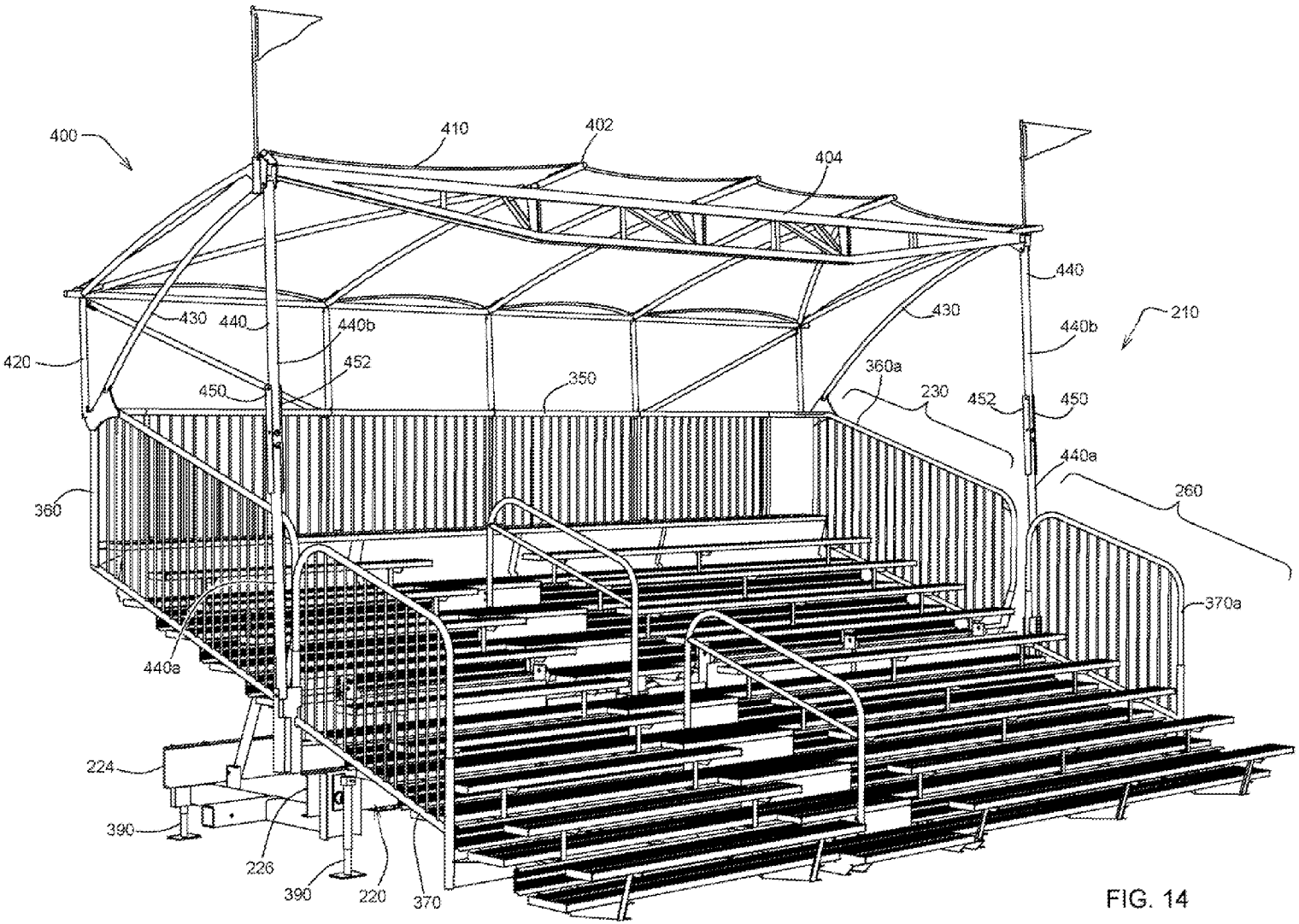
FIG. 14 is a perspective view of an exemplary 10-row bleacher system made in accordance with the present invention.
Figure 15:
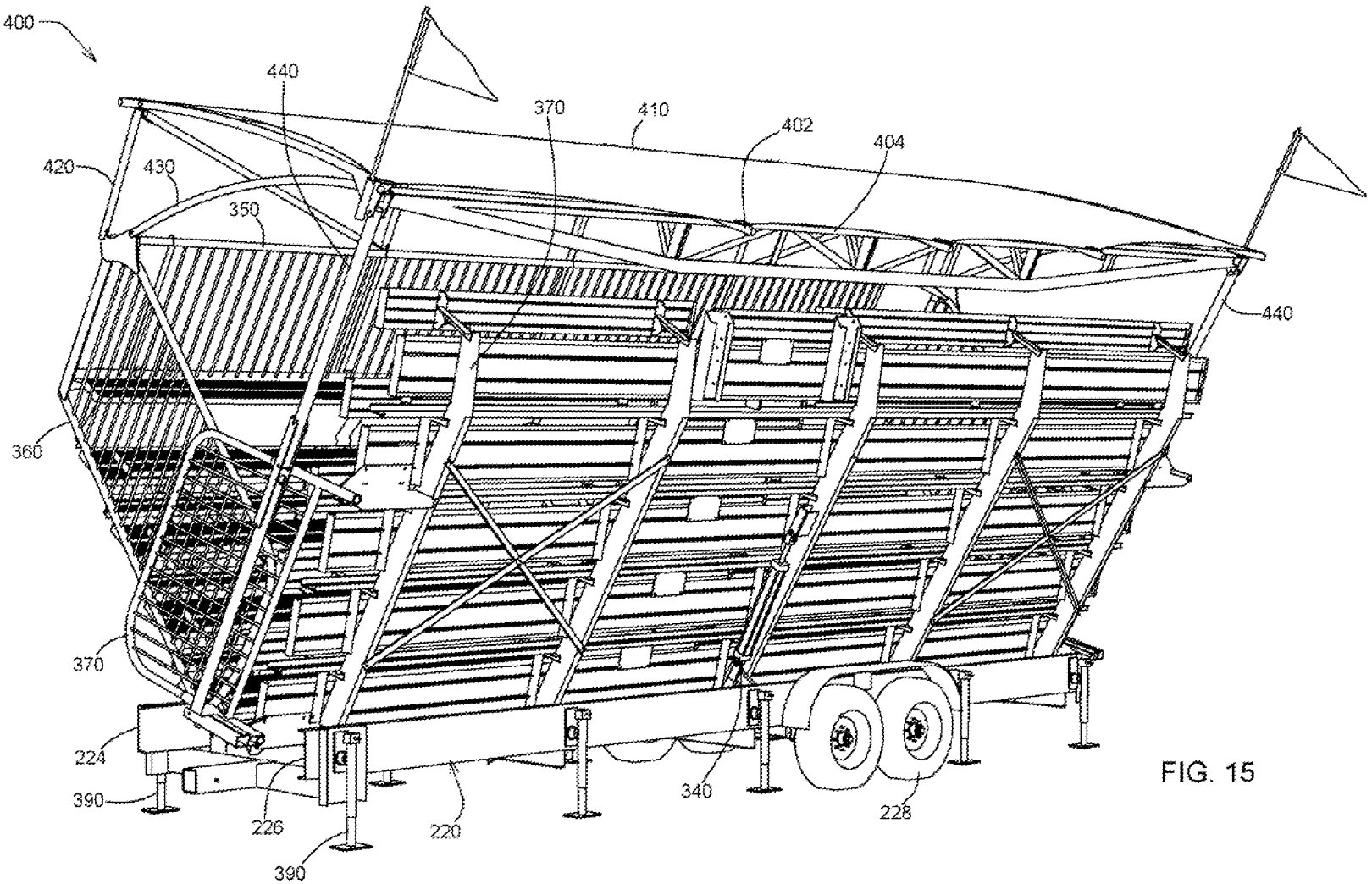
FIG. 15 is a perspective view of the exemplary bleacher system of FIG. 14 as it transitions from the deployed to the transport position.

In this exemplary embodiment, as perhaps best illustrated in FIGS. 14 and 15, each vertical support strut 440 is actually comprised of two discrete structural elements 440*a*, 440*b* that are connected to one another at a folding joint, so that each vertical support strut 440 can fold as it moves from the deployed position to the transport position. Specifically, adjacent ends of the two structural elements 440*a*, 440*b* are positioned between two plates 450, 452. Two plates 450, 452 are rigidly affixed to the lower structural element 440*a*. A pin 460 then passes through and connects the upper structural element 440*b* to the two plates 450, 452, such that the upper structural element 440*b* can pivot about an axis defined by the pin 460 relative to the lower structural element 440*a* and the two plates 450, 452. When in the deployed position, however, a locking pin 462 passes through and connects the upper structural element 440*b* to the two plates 450, 452, thus locking and preventing any pivoting of the upper structural element 440*b*. Of course, this is but one example of how the two structural elements 440*a*, 440*b* could be connected to and locked with respect to one another, and it is contemplated that various other latches or mechanisms could be used to connect or lock the two structural elements 440*a*, 440*b* without departing from the spirit and scope of the present invention.

Furthermore, as opposed to using a folding joint, it is also contemplated that each vertical support strut 440 could have a telescoping construction or otherwise allow for the transition of each vertical support strut 440 from an extended position to a retracted position, or vice versa.

Figure 16:
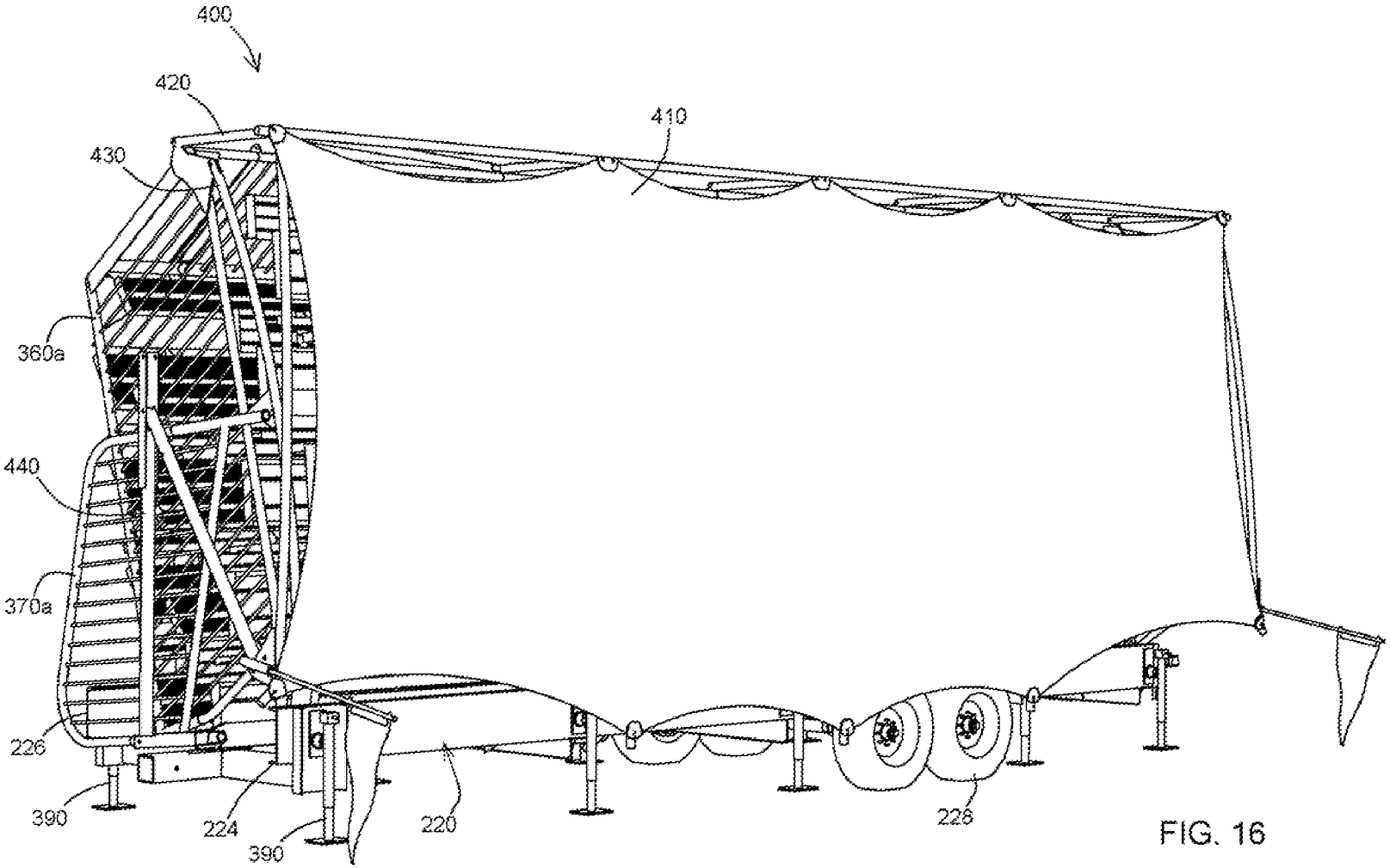
FIG. 16 is an alternate perspective view of the exemplary bleacher system of FIG. 14 in the transport position.

When the bleacher system 210 has been transitioned to the transport position, the canopy assembly 400 is initially still in its deployed position. Referring now to FIG. 27, to transition the canopy assembly 400 to the transport portion (i.e., close the canopy assembly 400), the locking pins 462 of the respective vertical support struts 440 are removed. Thus, as illustrated in FIG. 28, the upper structural element 440*b* of each vertical support strut 440 can then pivot (clockwise) relative to the lower structural element 440*a* and the two plates 450, 452. The pivoting of the upper structural elements 440*b* of each vertical support strut 440 continues, as illustrated in FIGS. 29-30, until the surface of the canopy 410 is substantially vertical, covering one side of the bleacher system 210 in the transport position, as illustrated in FIG. 16.

In transitioning the canopy assembly 400 from the transport position to the deployed position (i.e., opening the canopy assembly 400), the vertical support struts 440 are straightened, and the respective folding joints are locked by inserting the locking pins 462. Then, as the bleacher system 210 is deployed, the movement of the lower tier 260 raises the front truss 404 of the canopy assembly 400 to the desired position, while the multiple rear canopy struts 420 support the rear of the overhead frame 402 at the desired height above the upper tier 230.

Furthermore, as with the exemplary 15-row bleacher system 10 described above with respect to FIGS. 1-13, this exemplary 10-row bleacher system 210 is also equipped with leveling jacks 390 that are secured to the rails 224, 226 at spaced intervals along the length of the bleacher system 110.

One of ordinary skill in the art will also recognize that additional embodiments and configurations are also possible without departing from the teachings of the present invention or the scope of the claims which follow. This detailed description, and particularly the specific details of the exemplary embodiment disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A bleacher system, comprising:

a support structure mounted on wheels;

an upper tier and a second tier mounted on the support structure, with the upper tier being connected to the second tier by a pin connection defining a pivot point, and each tier including multiple girders at spaced intervals that are operably connected to the support structure, each girder supporting a plurality of seat supports and a plurality of foot board supports, with seat planks then secured to the seat supports and foot planks secured to the foot board supports in each tier; and at least one actuator operably connected to and extending between the support structure and the second tier, with the extension of the rod of the actuator causing the second tier to pivot about a pivot point relative to the support structure in a first direction, while causing the upper tier to pivot about a pivot point relative to the second tier in an opposite direction, such that the upper tier and the second tier move away from one another during the transition from a transport position into a deployed position;

wherein, in the transport position, each girder of each tier is in an upright orientation relative to the support structure.

2. The bleacher system as recited in claim 1, in which each tier includes five rows of seat supports and seat planks.

3. The bleacher system as recited in claim 1, wherein each girder of the upper tier is connected to a rear strut by a pin connection defining a pivot point, with an opposite end of each rear strut being connected to the support structure by another pin connection defining another pivot point.

4. A bleacher system, comprising:

a support structure mounted on wheels, said support structure including two parallel rails that are spaced from one another and extend the length of the bleacher system and multiple cross members that extend between and connect the two parallel rails;

an upper tier mounted on the support structure, said upper tier including multiple girders at spaced intervals that are operably connected to the support structure, each girder supporting a plurality of seat supports and a plurality of foot board supports, with seat planks then secured to the seat supports and foot planks secured to the foot board supports in the upper tier;

a second tier mounted on the support structure and pivotally connected to the upper tier about a pivot point, said second tier including multiple girders at spaced intervals that are operably connected to the support structure, each girder supporting a plurality of seat supports and a plurality of foot board supports, with seat planks then secured to the seat supports and foot planks secured to the foot board supports in the second tier; and at least one actuator for transitioning the second tier from a transport position into a deployed position, while also causing a corresponding movement of the upper tier from the transport position into the deployed position;

wherein, in the transport position, each girder of the upper tier and each girder of the second tier is in an upright orientation relative to the support structure; and wherein, in the transport position, the pivot point between the upper tier and the second tier is below an uppermost surface defined by the two parallel rails and is also at or below an uppermost surface of the respective cross members, such that portions of the upper tier and/or the second tier can extend below and fit between the two parallel rails and the respective cross members.

5. The bleacher system as recited in claim 4, in which the actuator is a hydraulic actuator.

6. The bleacher system as recited in claim 4, in which the upper tier and the second tier each include five rows of seat supports and seat planks 7. The bleacher system as recited in claim 4, wherein each girder of the upper tier is connected to a rear strut by a pin connection defining a pivot point, with an opposite end of each rear strut being connected to the support structure by another pin connection defining another pivot point.

8. The bleacher system as recited in claim 7, wherein the upper tier is connected to the second tier by a pin connection defining a pivot point.

9. The bleacher system as recited in claim 8, wherein each girder of the second tier includes a generally triangular-shaped strut, and wherein the pivot point defined by the pin connection between the upper tier and the second tier is at a rear corner of the strut, and a lower corner of the strut is mounted to the support structure for rotation about a main pivot point, such that the second tier can effectively rotate about the main pivot point.

10. The bleacher system as recited in claim 4, and further comprising one or more outrigger jacks adapted for contacting the underlying ground surface to maintain stability as the bleacher system transitions from the transport position to the deployed position, wherein each such outrigger jack is pivotally connected to the support structure and moveable between a deployed position and a storage position.

11. The bleacher system as recited in claim 4, and further comprising a lower tier mounted on the support structure and pivotally connected to the second tier, said lower tier including multiple girders at spaced intervals that are operably connected to the support structure, each girder supporting a plurality of seat supports and a plurality of foot board supports, with seat planks then secured to the seat supports and foot planks secured to the foot board supports in the lower tier, and wherein, in the transport position, each girder of the lower tier is in an upright orientation.

12. The bleacher system as recited in claim 11, wherein the lower tier is connected to the second tier by a pin connection defining a pivot point.

13. The bleacher system as recited in claim 12, and further comprising a support cable associated with each girder of the lower tier, said support cable being connected to and extending from each girder of the lower tier to a corresponding girder of the second tier, wherein said support cable is pulled taut as the bleacher system is transitioned into the deployed position.

14. The bleacher system as recited in claim 12, and further comprising one or more deployment link support structures that are secured to or integral with the support structure, with each actuator being connected to a respective deployment link support structure at a first end by a pin connection defining a pivot point, and the rod of each actuator then being connected to the second tier by another pin connection defining another pivot point.

15. The bleacher system as recited in claim 14, and further comprising:

a first deployment link pivotally connected to each deployment link support structure; and a second deployment link pivotally connected to a distal end of the first deployment link at one end and pivotally connected to a respective girder of the lower tier at an opposite end;

wherein, the first deployment link and the second deployment link are aligned and in tension when the bleacher system is in the deployed position, but as the bleacher system transitions from the deployed position to the transport position, the first deployment link and the second deployment link begin to rotate and fold relative to one another.

16. The bleacher system as recited in claim 11, and further comprising:

a first set of left and right end guardrails associated with and secured to the upper tier;

a second set of left and right end guardrails associated with and secured to the second tier;

a third set of left and right end guardrails associated with and secured to the lower tier; and a rear guardrail that extends the length of the bleacher system;

wherein, as the bleacher system is transitioned from the deployed position to the transport position, the respective sets of end guardrails rotate with the respective tiers until, in the transport position, they are essentially in a stacked relationship with respect to one another at either end of the bleacher system.

17. A bleacher system, comprising:

a support structure mounted on wheels;

an upper tier mounted on the support structure, said upper tier including multiple girders at spaced intervals that are operably connected to the support structure, each girder supporting a plurality of seat supports and a plurality of foot board supports, with seat planks then secured to the seat supports and foot planks secured to the foot board supports in the upper tier;

a second tier mounted on the support structure and pivotally connected to the upper tier about a pivot point, said second tier including multiple girders at spaced intervals that are operably connected to the support structure, each girder supporting a plurality of seat supports and a plurality of foot board supports, with seat planks then secured to the seat supports and foot planks secured to the foot board supports in the second tier;

at least one actuator for transitioning the second tier from a transport position into a deployed position, while also causing a corresponding movement of the upper tier from the transport position into the deployed position; and a canopy assembly, including an overhead frame with a front truss, a canopy supported by the overhead frame, multiple rear struts that are pivotally connected to the rear of the overhead frame and pivotally connected to the upper tier, two diagonal support struts, one at each end of the bleacher system, with each diagonal support strut being pivotally connected to the upper tier at a first end and pivotally connected to an end of the front truss of the overhead frame at a second end, and two vertical support struts, one at each end of the bleacher system, with each vertical support strut being pivotally connected to the front truss of the overhead frame at a first end and pivotally connected to the second tier at a second end, each vertical support strut being adapted to transition between an extended position and a retracted position.

* * * * *